US011189971B2

(12) United States Patent
Lu

(10) Patent No.: US 11,189,971 B2
(45) Date of Patent: Nov. 30, 2021

(54) ROBUST, HIGH-FREQUENCY ELECTRICAL CONNECTOR

(71) Applicant: Amphenol East Asia Ltd., Taoyuan (TW)

(72) Inventor: Lo-Wen Lu, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 28 days.

(21) Appl. No.: 16/556,778

(22) Filed: Aug. 30, 2019

(65) Prior Publication Data

US 2020/0266584 A1 Aug. 20, 2020

Related U.S. Application Data

(60) Provisional application No. 62/805,812, filed on Feb. 14, 2019.

(51) Int. Cl.
*H01R 13/6471* (2011.01)
*H01R 43/26* (2006.01)
(Continued)

(52) U.S. Cl.
CPC ..... *H01R 13/6471* (2013.01); *H01R 12/75* (2013.01); *H01R 13/502* (2013.01); *H01R 13/6581* (2013.01); *H01R 43/26* (2013.01)

(58) Field of Classification Search
CPC .... H01C 3/6471; H01C 3/502; H01C 3/6581; H01R 12/75; H01R 43/26
See application file for complete search history.

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1179448 C 12/2004
CN 1799290 A 7/2006
(Continued)

OTHER PUBLICATIONS

U.S. Appl. No. 16/556,728, filed Aug. 30, 2019, Lu.
(Continued)

*Primary Examiner* — Abdullah A Riyami
*Assistant Examiner* — Nader J Alhawamdeh
(74) *Attorney, Agent, or Firm* — Wolf, Greenfield & Sacks, P.C.

(57) ABSTRACT

An electrical connector includes an insulative portion, a plurality of terminals supported by the insulative portion and are disposed in a row, and a lossy member. Each of the terminals includes a first end, a mounting end, and an intermediate portion. The lossy member includes a body portion elongated in a row direction and a plurality of projections extending from the body portion toward the first ends of a subset of the terminals. Each of the terminals includes a first surface and a second surface opposite the first surface, with the first face including a first contact region. The projections of the lossy member are aligned with the second surfaces of the subset of terminals. Upon mating the electrical connector to a complementary connector, the terminals may deflect towards the projections of the lossy member, improving contact with the lossy member and thus improving its effectiveness.

38 Claims, 19 Drawing Sheets

(51) Int. Cl.

| | |
|---|---|
| ***H01R 12/75*** | (2011.01) |
| ***H01R 13/502*** | (2006.01) |
| ***H01R 13/6581*** | (2011.01) |

(56) References Cited

U.S. PATENT DOCUMENTS

| | | | |
|---|---|---|---|
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |
| 4,155,613 | A | 5/1979 | Brandeau |
| 4,195,272 | A | 3/1980 | Boutros |
| 4,276,523 | A | 6/1981 | Boutros et al. |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,632,476 | A | 12/1986 | Schell |
| 4,636,752 | A | 1/1987 | Saito |
| 4,682,129 | A | 7/1987 | Bakermans et al. |
| 4,751,479 | A | 6/1988 | Parr |
| 4,761,147 | A | 8/1988 | Gauthier |
| 4,806,107 | A | 2/1989 | Arnold et al. |
| 4,846,724 | A | 7/1989 | Sasaki et al. |
| 4,846,727 | A | 7/1989 | Glover et al. |
| 4,878,155 | A | 10/1989 | Conley |
| 4,948,922 | A | 8/1990 | Varadan et al. |
| 4,970,354 | A | 11/1990 | Iwasa et al. |
| 4,975,084 | A | 12/1990 | Fedder et al. |
| 4,992,060 | A | 2/1991 | Meyer |
| 5,000,700 | A | 3/1991 | Masubuchi et al. |
| 5,066,236 | A | 11/1991 | Broeksteeg |
| 5,141,454 | A | 8/1992 | Garrett et al. |
| 5,150,086 | A | 9/1992 | Ito |
| 5,166,527 | A | 11/1992 | Solymar |
| 5,168,252 | A | 12/1992 | Naito |
| 5,168,432 | A | 12/1992 | Murphy et al. |
| 5,176,538 | A | 1/1993 | Hansell, III et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,334,050 | A | 8/1994 | Andrews |
| 5,340,334 | A | 8/1994 | Nguyen |
| 5,346,410 | A | 9/1994 | Moore, Jr. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,456,619 | A | 10/1995 | Belopolsky et al. |
| 5,461,392 | A | 10/1995 | Mott et al. |
| 5,474,472 | A | 12/1995 | Niwa et al. |
| 5,484,310 | A | 1/1996 | McNamara et al. |
| 5,496,183 | A | 3/1996 | Soes et al. |
| 5,499,935 | A | 3/1996 | Powell |
| 5,551,893 | A | 9/1996 | Johnson |
| 5,562,497 | A | 10/1996 | Yagi et al. |
| 5,597,328 | A | 1/1997 | Mouissie |
| 5,651,702 | A | 7/1997 | Hanning et al. |
| 5,669,789 | A | 9/1997 | Law |
| 5,796,323 | A | 8/1998 | Uchikoba et al. |
| 5,831,491 | A | 11/1998 | Buer et al. |
| 5,924,899 | A | 7/1999 | Paagman |
| 5,981,869 | A | 11/1999 | Kroger |
| 5,982,253 | A | 11/1999 | Perrin et al. |
| 6,019,616 | A | 2/2000 | Yagi et al. |
| 6,152,747 | A | 11/2000 | McNamara |
| 6,168,469 | B1 | 1/2001 | Lu |
| 6,174,203 | B1 | 1/2001 | Asao |
| 6,174,944 | B1 | 1/2001 | Chiba et al. |
| 6,217,372 | B1 | 4/2001 | Reed |
| 6,293,827 | B1 | 9/2001 | Stokoe |
| 6,296,496 | B1 | 10/2001 | Trammel |
| 6,299,438 | B1 | 10/2001 | Shagian et al. |
| 6,299,483 | B1 | 10/2001 | Cohen et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,364,711 | B1 | 4/2002 | Berg et al. |
| 6,375,510 | B2 | 4/2002 | Asao |
| 6,379,188 | B1 | 4/2002 | Cohen et al. |
| 6,398,588 | B1 | 6/2002 | Bickford |
| 6,409,543 | B1 | 6/2002 | Astbury, Jr. et al. |
| 6,482,017 | B1 | 11/2002 | Van Doorn |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,530,790 | B1 | 3/2003 | McNamara et al. |
| 6,537,087 | B2 | 3/2003 | McNamara et al. |
| 6,554,647 | B1 | 4/2003 | Cohen et al. |
| 6,565,387 | B2 | 5/2003 | Cohen |
| 6,565,390 | B2 * | 5/2003 | Wu ..... H01R 12/7005 439/378 |
| 6,579,116 | B2 | 6/2003 | Brennan et al. |
| 6,582,244 | B2 | 6/2003 | Fogg et al. |
| 6,595,802 | B1 | 7/2003 | Watanabe et al. |
| 6,602,095 | B2 | 8/2003 | Astbury, Jr. et al. |
| 6,616,864 | B1 | 9/2003 | Jiang et al. |
| 6,652,318 | B1 | 11/2003 | Winings et al. |
| 6,655,966 | B2 | 12/2003 | Rothermel et al. |
| 6,709,294 | B1 | 3/2004 | Cohen et al. |
| 6,713,672 | B1 | 3/2004 | Stickney |
| 6,743,057 | B2 | 6/2004 | Davis et al. |
| 6,776,659 | B1 | 8/2004 | Stokoe et al. |
| 6,786,771 | B2 | 9/2004 | Gailus |
| 6,814,619 | B1 | 11/2004 | Stokoe et al. |
| 6,830,489 | B2 | 12/2004 | Aoyama |
| 6,872,085 | B1 | 3/2005 | Cohen et al. |
| 6,979,226 | B2 | 12/2005 | Otsu et al. |
| 7,044,794 | B2 | 5/2006 | Consoli et al. |
| 7,057,570 | B2 | 6/2006 | Irion, II et al. |
| 7,074,086 | B2 | 7/2006 | Cohen et al. |
| 7,094,102 | B2 | 8/2006 | Cohen et al. |
| 7,108,556 | B2 | 9/2006 | Cohen et al. |
| 7,163,421 | B1 | 1/2007 | Cohen et al. |
| 7,285,018 | B2 | 10/2007 | Kenny et al. |
| 7,335,063 | B2 | 2/2008 | Cohen et al. |
| 7,494,383 | B2 | 2/2009 | Cohen et al. |
| 7,540,781 | B2 | 6/2009 | Kenny et al. |
| 7,581,990 | B2 | 9/2009 | Kirk et al. |
| 7,588,464 | B2 | 9/2009 | Kim |
| 7,699,644 | B2 | 4/2010 | Szczesny et al. |
| 7,722,401 | B2 | 5/2010 | Kirk et al. |
| 7,731,537 | B2 | 6/2010 | Amleshi et al. |
| 7,753,731 | B2 | 7/2010 | Cohen et al. |
| 7,771,233 | B2 | 8/2010 | Gailus |
| 7,794,240 | B2 | 9/2010 | Cohen et al. |
| 7,794,278 | B2 | 9/2010 | Cohen et al. |
| 7,806,729 | B2 | 10/2010 | Nguyen et al. |
| 7,874,873 | B2 | 1/2011 | Do et al. |
| 7,887,371 | B2 | 2/2011 | Kenny et al. |
| 7,887,379 | B2 | 2/2011 | Kirk |
| 7,906,730 | B2 | 3/2011 | Atkinson et al. |
| 7,914,304 | B2 | 3/2011 | Cartier et al. |
| 7,985,097 | B2 | 7/2011 | Gulla |
| 8,083,553 | B2 | 12/2011 | Manter et al. |
| 8,182,289 | B2 | 5/2012 | Stokoe et al. |
| 8,215,968 | B2 | 7/2012 | Cartier et al. |
| 8,216,001 | B2 | 7/2012 | Kirk |
| 8,272,877 | B2 | 9/2012 | Stokoe et al. |
| 8,348,701 | B1 | 1/2013 | Lan et al. |
| 8,371,875 | B2 | 2/2013 | Gailus |
| 8,382,524 | B2 | 2/2013 | Khilchenko et al. |
| 8,657,627 | B2 | 2/2014 | McNamara et al. |
| 8,715,003 | B2 | 5/2014 | Buck et al. |
| 8,771,016 | B2 | 7/2014 | Atkinson et al. |
| 8,864,521 | B2 | 10/2014 | Atkinson et al. |
| 8,926,377 | B2 | 1/2015 | Kirk et al. |
| 8,944,831 | B2 | 2/2015 | Stoner et al. |

(56) References Cited

U.S. PATENT DOCUMENTS 8,998,642 B2 4/2015 Manter et al.
9,004,942 B2 4/2015 Paniauqa
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,300,074 B2 3/2016 Gailus
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,742,132 B1 8/2017 Hsueh
9,972,945 B1 5/2018 Huang et al.
10,122,129 B2 11/2018 Milbrand, Jr. et al.
10,243,304 B2 3/2019 Kirk et al.
10,270,191 B1 4/2019 Li et al.
10,283,910 B1 5/2019 Chen et al.
10,348,040 B2 7/2019 Cartier et al.
10,381,767 B1 8/2019 Milbrand, Jr. et al.
10,601,181 B2 * 3/2020 Lu ..... H01R 13/6272
10,777,921 B2 * 9/2020 Lu ..... H01R 12/82
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacant et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0081302 A1 4/2010 Atkinson et al.
2010/0294530 A1 11/2010 Atkinson et al.
2011/0003509 A1 1/2011 Gailus
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0090001 A1 * 4/2013 Kagotani ..... H01R 13/60 439/378
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0111427 A1 4/2015 Foxconn
2015/0236451 A1 8/2015 Cartier, Jr. et al.
2015/0236452 A1 8/2015 Cartier, Jr. et al.
2015/0255926 A1 9/2015 Paniagua
2016/0149343 A1 5/2016 Atkinson et al.
2017/0352970 A1 * 12/2017 Liang ..... H01R 12/7052
2018/0062323 A1 3/2018 Kirk et al.
2018/0145438 A1 5/2018 Cohen
2018/0205177 A1 * 7/2018 Zhou ..... H01R 13/631
2018/0212376 A1 7/2018 Wang et al.
2018/0219331 A1 8/2018 Cartier et al.
2018/0269607 A1 * 9/2018 Wu ..... H01R 13/6275
2019/0052019 A1 2/2019 Huang et al.
2019/0067854 A1 * 2/2019 Ju ..... H01R 12/727
2019/0173209 A1 6/2019 Lu et al.
2019/0173232 A1 6/2019 Lu et al.
2020/0259294 A1 * 8/2020 Lu ..... H01R 12/57
2020/0266584 A1 * 8/2020 Lu ..... H01R 12/79

FOREIGN PATENT DOCUMENTS

CN 101176389 A 5/2008
CN 101600293 A 12/2009
CN 101790818 A 7/2010
CN 101120490 B 11/2010
CN 201846527 U 5/2011
CN 102239605 A 11/2011
CN 101600293 B 5/2012
CN 102598430 A 7/2012
CN 202395248 U 8/2012
CN 104409906 A 3/2015
CN 304240766 S 8/2017
CN 304245430 S 8/2017
CN 206712089 U 12/2017
CN 207677189 U 7/2018
DE 60216728 T2 11/2007
EP 1018784 A1 7/2000
EP 1779472 A1 5/2007
EP 2169770 A2 3/2010
EP 2405537 A1 1/2012
GB 1272347 A 4/1972
JP 07302649 A 11/1995
JP 2001-510627 A 7/2001
JP 2006-344524 A 12/2006
MX 9907324 A1 8/2000
TW M558481 U 4/2018
TW M558482 U 4/2018
TW M558483 U 4/2018
TW M559006 U 4/2018
TW M559007 U 4/2018
TW M560138 U 5/2018
TW M562507 U 6/2018
TW M565894 Y 8/2018
TW M565895 Y 8/2018

(56) References Cited

FOREIGN PATENT DOCUMENTS

| | | | |
|---|---|---|---|
| TW | M565899 | Y | 8/2018 |
| TW | M565900 | Y | 8/2018 |
| TW | M565901 | Y | 8/2018 |
| WO | WO 88/05218 | | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

U.S. Appl. No. 16/684,755, filed Nov. 15, 2019, Lu.
U.S. Appl. No. 16/721,594, filed Dec. 19, 2019, Lu.
International Search Report and Written Opinion for International Application No. PCT/CN2017/108344 dated Aug. 1, 2018.
International Search Report and Written Opinion for International Application No. PCT/US2010/056482 dated Mar. 14, 2011.
International Preliminary Report on Patentability for International Application No. PCT/US2010/056482 dated May 24, 2012.
International Search Report and Written Opinion for International Application No. PCT/US2011/026139 dated Nov. 22, 2011.
International Preliminary Report on Patentability for International Application No. PCT/US2011/026139 dated Sep. 7, 2012.
International Search Report and Written Opinion for International Application No. PCT/US2012/023689 dated Sep. 12, 2012.
International Preliminary Report on Patentability for International Application No. PCT/US2012/023689 dated Aug. 15, 2013.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
Extended European Search Report for European Application No. EP 11166820.8 dated Jan. 24, 2012.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Search Report and Written Opinion for International Application No. PCT/US2011/034747 dated Jul. 28, 2011.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables. 1997 Electronic Components and Technology Conference. 1997;911-7.
Shi et al., Improving Signal Integrity in Circuit Boards by Incorporating Absorbing Materials. 2001 Proceedings. 51st Electronic Components and Technology Conference, Orlando FL. 2001:1451-56.

* cited by examiner

ROBUST, HIGH-FREQUENCY ELECTRICAL CONNECTOR

CROSS-REFERENCE TO RELATED APPLICATIONS

The present application claims the benefit under 35 U.S.C. § 119(e) of U.S. Provisional Patent Application Ser. No. 62/805,812, filed on Feb. 14, 2019, entitled "ROBUST, HIGH FREQUENCY ELECTRICAL CONNECTOR," the entire contents of which is hereby incorporated by reference herein in its entirety.

FIELD OF THE INVENTION

This disclosure relates generally to electrical interconnection systems and more specifically to electrical connectors able to carry high-frequency signals.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signal transmission to transfer information (e.g., data, commands, and/or other electrical signals) often utilize electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated one or both ends with a plug type of electrical connector ("plug connector" herein). A PCB may be equipped with a receptacle type of electrical connector ("receptacle connector" herein) into which the plug connector may be inserted to connect the cable to the PCB. A similar arrangement may be used at the other end of the cable, to connect the cable to another PCB, so that signals may pass between the PCBs via the cable.

To facilitate manufacture of different parts of electronic devices in different places by different companies, aspects of the receptacle connectors and the plug connectors may be standardized, either through a formal standard-setting process or through adoption of a particular design by a large number of manufacturers. An example of an interconnection standard is the SAS or Serial Attached SCSI (Small Computer System Interface) standard. Another example is the SFP or Single Form-Factor Pluggable standard, as well as its variations: SFP+, QSFP, QSFP+, etc. Different standards have been developed as electronic devices generally have gotten smaller, faster, and functionally more complex. The different standards allow for different combinations of speed and density within a connector system.

For electronic devices that require a high-density, high-speed connector, techniques may be used to reduce interference between conductive elements within the connectors, and to provide other desirable electrical properties. One such technique involves the use of shield members between or around adjacent signal conductive elements of a connector system. The shields may prevent signals carried on one conductive element from creating "crosstalk" on another conductive element. The shields may also have an impact on an impedance of the conductive elements, which may further contribute to desirable electrical properties of the connector system.

Another technique that may be used to control performance characteristics of a connector entails transmitting signals differentially. Differential signals result from signals carried on a pair of conducting paths, called a "differential pair." The voltage difference between the conductive paths represents the differential signal. In general, a differential pair is designed with preferential coupling between the conducting paths of the pair. For example, the two conducting paths of a differential pair may be arranged to run closer to each other than to other adjacent signal paths in the connector.

Amphenol Corporation, which is the assignee of the present technology described herein, also pioneered the use of a "lossy" material in connectors to improve performance, particularly the performances of high-speed, high-density connectors.

SUMMARY

According to some aspects of the present technology, an electrical connector, is provided. The connector may include an insulative portion, a plurality of terminals supported by the insulative portion, and a lossy member. The terminals may be disposed in a row along a row direction. Each of the terminals may be comprised of a first end, a mounting end, and an intermediate portion joining the first end to the mounting end. The lossy member may be comprised of a body portion elongated in the row direction and a plurality of projections extending from the body portion toward the first ends of a plurality of first terminals of the terminals supported by the insulative portion. Each of the terminals may be comprised of a first surface and a second surface opposite the first surface, with the first surface including a first contact region thereon. The projections of the lossy member may be aligned with the second surfaces of the first terminals.

In an aspect, the projections of the lossy members may be configured to make contact with the second surfaces of the first terminals.

In an aspect, the insulative portion may be molded around first segments of the intermediate portions of the terminals. Second segments of the intermediate portions of the terminals may extend from the insulative portion, such that the projections of the lossy member may make contact with the second surfaces of the first terminals at locations on the second segments between the insulative portion and the first ends of the first terminals.

In an aspect, the mounting ends may be comprised of surface-mount contact tails.

In an aspect, the terminals may be comprised of the first terminals and a plurality of second terminals. Each of the second terminals may have a second width, and each of the first terminals may have a first width greater than the second width. The projections of the lossy member may be aligned with the second surfaces of the first terminals, and may be separated, in the row direction, from the second terminals.

In an aspect, the second terminals may be comprised of pairs of second terminals. Each of the pairs of second terminals may be separated from another of the pairs of second terminals by a first terminal.

In an aspect, the connector may be a receptacle connector. The first contact regions may be comprised of plug contact regions configured to make physical contact with corresponding plug terminals when a plug connector is mated with the receptacle connector.

In an aspect, the connector may be further comprised of an insulative member. The insulative member be comprised of a wall that includes a plurality channels. The first ends of the terminals and sections of the intermediate portions of the terminals may be disposed in the channels such that the first contact regions are exposed. The projections of the lossy member may be comprised of second contact regions disposed in first channels of the channels of the wall. The first channels may be configured to correspond to the first terminals. The second contact regions of the projections of the lossy member may be disposed in the first channels between the second surfaces of the first terminals and the insulative member.

In an aspect, the connector may be a receptacle connector in combination with a plug connector. The plug connector may be comprised of a plurality of mating terminals in contact with the terminals of the receptacle connector at first contact locations in the first contact regions. The mating terminals may apply a force to the first terminals that deflects the first ends of the first terminals, such that the first terminals are urged toward and physically contact the second contact regions of the projections of the lossy member at second contact locations.

In an aspect, the receptacle connector may be in combination with the plug connector such that, for the first terminals that are in physical contact with the projections of the lossy member at the second contact regions, the first contact locations and the second contact locations are within a predetermined distance from longitudinal midpoints of the first terminals.

In an aspect, the first terminals may be ground terminals. For each of the ground terminals, the first end may be angled, the mounting end may be angled, and the intermediate portion may be substantially straight and may be elongated in a direction perpendicular to the row direction. The longitudinal midpoint of each of the ground terminals may be a longitudinal midpoint of the intermediate portion.

In various aspects, the predetermined distance between the longitudinal midpoint and the first contact location and/or the second contact location may be within about 1 mm; or within about 0.8 mm, or within about 0.6 mm, or within about 0.4 mm, or within about 0.2 mm.

In various aspects, the predetermined distance may be between about 0.2 mm and about 1 mm; or less than about 0.8 mm; or less than about 0.2 mm.

According to some aspects of the present technology, an electrical connector is provided. The connector may include an insulative housing, a plurality of terminals, first and second terminal assemblies, and a lossy member. The terminals may be comprised of a plurality of first terminals and a plurality of second terminals. The first terminal assembly may be disposed in the housing and may be comprised of a first support bar and a first portion of the terminals may be attached to the first support bar. The second terminal assembly may be disposed in the housing and may be comprised of a second support bar and a second portion of the terminals may be attached to the second support bar. The lossy member may be disposed in the housing and may be comprised of a body portion and a plurality of projections extending from the body portion. The first and second support bars may be elongated in a first direction, and the body portion of the lossy member may be disposed between the first and second support bars. Each of the terminals may be comprised of an intermediate portion extending from the first support bar or the second support bar. Each intermediate portion of the terminals may be elongated in a second direction perpendicular to the first direction, and the projections of the lossy member may extend from the body portion in the second direction. The projections of the lossy member may be comprised of a plurality of contact portions that extend towards the intermediate portions of the first terminals, in a direction perpendicular to the first direction and perpendicular to the second direction. Each of the first and second terminal assemblies may include a subset of the first terminals and a subset of the second terminals.

In an aspect, each of the projections of the lossy member may be L-shaped.

In an aspect, the first terminals may be comprised of ground terminals, and the second terminals may be comprised of pairs of signal terminals. The pairs of signal terminals and the ground terminals may be arranged in an alternating pattern on the first and second support bars, such that no two pairs of the pairs of signal terminals are adjacent each other. The contact portions of the projections of the lossy member may extend towards the intermediate portions of the ground terminals.

In an aspect, each of the terminals may be comprised of a mounting end and a free distal end sandwiching the intermediate portion therebetween. The mounting ends may be configured to be fixedly mounted to a circuit board, and the free distal ends may deflect or be movable relative to the mounting ends.

In an aspect, each of the terminals may be comprised of a first surface and a second surface, opposite the first surface. The first surface may be comprised of a first contact surface. The contact portions of the projections of the lossy member that extend towards the intermediate portions of the first terminals may be positioned adjacent the second surfaces of the first terminals.

In an aspect, the connector may be a receptacle connector. The insulative housing may be comprised of a plug-receiving opening and at least one wall with a surface facing into the opening. The terminals may be arranged such that the first surfaces face into the opening and the free distal ends extend into channels in the at least one wall.

In an aspect, the at least one wall may be comprised of first and second walls. The channels may be disposed in the first and second walls. The terminals may be configured such that the free distal ends are disposed within the channels, and the contact portions of the projections of the lossy member that extend towards the intermediate portions of the first terminals may be positioned adjacent the second surfaces of the first terminals and may be within corresponding ones of the channels.

In an aspect, each of the first support bar of the first terminal assembly, the second support bar of the second terminal assembly, and the body portion of the lossy member may have a first end and a second end. The body portion of the lossy member may be elongated in the first direction and may have a length that is longer than a length of the first support bar and longer than a length of the second support bar. The first end of the body portion of the lossy member may be substantially aligned with the first end of the first support bar, and a second end of the body portion of the lossy member may be substantially aligned with the second end of the second support bar, such that the first end of the body portion of the lossy member may extend beyond the first end of the second support bar, and such that the second end of the body portion of the lossy member may extend beyond the second end of the first support bar.

In an aspect, the body portion of the lossy member may be comprised of a first side on which the first terminal assembly is arranged and a second side on which the second terminal assembly is arranged. The projections of the lossy member may include first projections arranged on the first side of the body portion and second projections arranged on the second side of the body portion. An arrangement of the first projections on the first side of the body portion relative to an arrangement of the second projections on the second side of the body portion may be staggered in the first direction.

In an aspect, the arrangement of the first projections and the arrangement of the second projections are such that no two projections of the projections of the lossy member share a common longitudinal position along the body portion of the lossy member.

In an aspect, the connector may be a receptacle connector, which may be combined with a plug connector. The plug connector may be comprised of a plurality of mating terminals in contact with the terminals of the receptacle connector at first contact locations in the first contact regions. The mating terminals may apply a force to the terminals of the receptacle connector that may deflect the free distal ends of the terminals of the receptacle connector, such that the first terminals of the receptacle connector may be urged toward and physically contact the contact portions of the projections of the lossy member at second contact locations on the second surfaces of the first terminals of the receptacle connector.

In an aspect, the receptacle connector may be in combination with the plug connector such that, for the first terminals of the receptacle connector that are in physical contact with the projections of the lossy member at the second contact locations, the first contact locations and the second contact locations may be within a predetermined distance from a longitudinal midpoint of the first terminals.

In various aspects, the predetermined distance may be within about 1 mm, or within about 0.8 mm, or within about 0.6 mm, or within about 0.4 mm, or within about 0.2 mm.

In various aspects, the predetermined distance may be between about 0.2 mm and about 1 mm, or less than about 0.8 mm, or less than about 0.2 mm.

In an aspect, the first terminals may be ground terminals. For each of the ground terminals, an angled first end and an angled second end may sandwich the intermediate portion therebetween. A longitudinal midpoint of each of the ground terminals may be a longitudinal midpoint of the intermediate portion.

In an aspect, for each of the ground terminals, the intermediate portion may be substantially straight.

According to some aspects of the present technology, a method of operating an electrical connector is provided. The method may comprise aligning the electrical connector with a mating electrical connector such that first terminals of the electrical connector align with second terminals of the mating electrical connector. The method also may comprise pressing the electrical connector and the mating electrical connector together such that: contact points between the first terminals and the second terminals slide in a direction from a first end of the first terminals towards a second end of the first terminals, and the first terminals deflect so as to increase a contact force between the first terminals and electrically interconnected lossy members.

In an aspect, the first terminals may be held by an insulative portion of the electrical connector at anchor points that are a first distance from the second end of the first terminals. When the first terminals deflect, the first terminals may contact the electrically interconnected lossy members at first contact points that are a second distance from the second end of the first terminals. The second terminals may contact the first terminals at second contact points that are a third distance from the second end of the first terminals. The third distance may be greater than the second distance, and the second distance may be greater than the first distance.

In an aspect, when the first terminals deflect, the contact force between the first terminals and the electrically interconnected lossy members may increase from 0 to in excess of 10 Newtons.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

Figure 1:
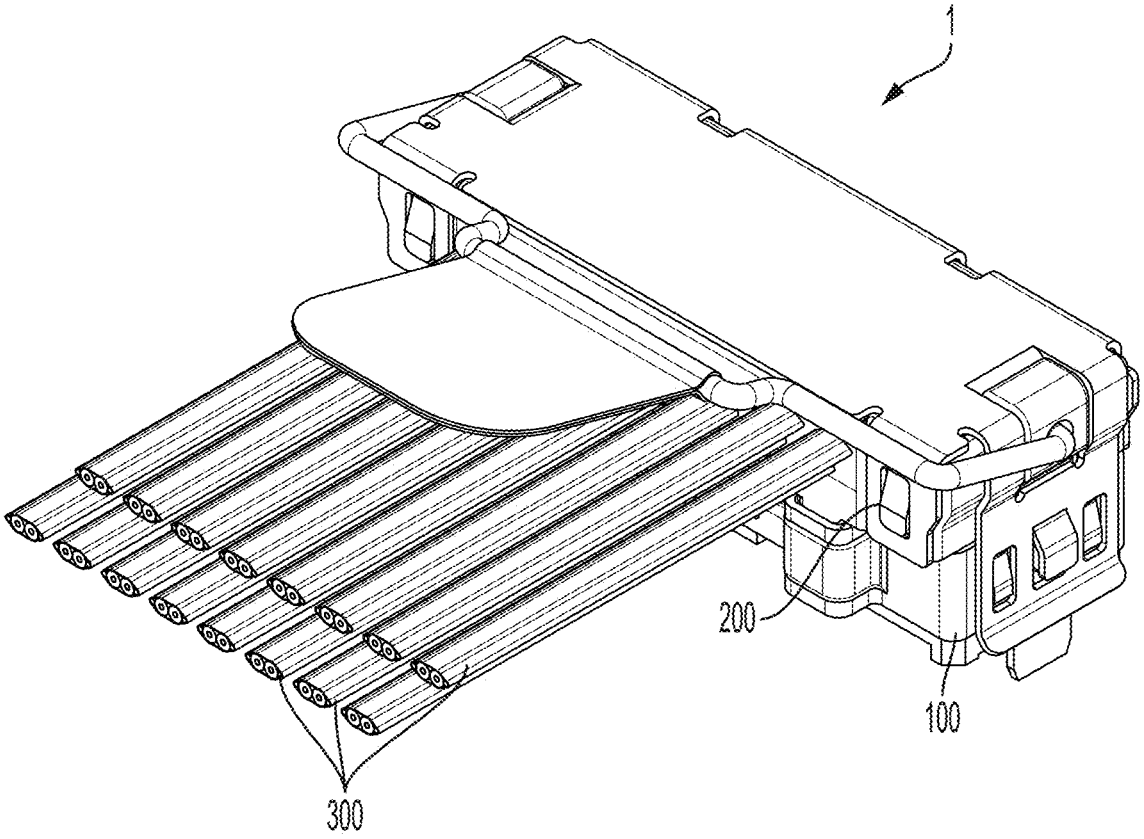
FIG. 1 is a top perspective view of a plug connector and a receptacle connector in an engaged or mated state, in accordance with some embodiments of the present technology.

The inventors have recognized and appreciated that that the high-frequency performance of a miniaturized electrical connector including a shorting member may be substantially improved by configuring the connector so that mating forces applied to conductive elements of the connector increase the electrical coupling between select ones of the conductive elements and the shorting member. The shorting member may be a lossy member, which may be formed of a lossy material. The select ones of the conductive members may be ground conductors.

The shorting member may have surfaces configured for making contact to the select ones of the conductive members ("select conductive members" herein). Those contact surfaces may be aligned with surfaces on portions of the select conductive members that deflect when the connector is mated with a complementary connector. Deflection of the select conductive members may press the select conductive members towards the contact surfaces of the shorting member, increasing the coupling between the select conductive members and the shorting member. In some embodiments, the shorting member may have projections that position the contact surfaces of the shorting member away from an insulative bar holding the select conductive members and towards a free distal end of the select conductive members such that the contact surfaces are positioned adjacent surfaces of the select conductive members that deflect upon mating.

A connector with this configuration may function reliably despite variations in component sizes that are likely to occur during manufacture of the components that are assembled to make the connector. Such variation, for example, may result in connectors in which the shorting member is manufactured separately from terminal subassemblies that carry the conductive members. The inventors have recognized and appreciate that, although the shorting member may be designed to contact the select conductive members, in some connectors, when assembled, manufacturing variations prevent the shorting member from contacting some or all of the select conductive members. Deflecting the select conductive members towards contact surfaces on the shorting member may increase electrical coupling between the select conductive members and the shorting member, either as a result of closer proximity between the two or increasing the contact force between the select conductive members and the shorting member. The contact force may increase, for example, as a result of the select conductive members being pressed into contact with the shorting member such that the contact force goes from zero to a finite value, such as 10 Newtons or more. If the select conductive members are already in contact with the shorting member before the connector is mated with a complementary connector, the additional mating force may reduce the impedance of that contact, improving the performance of the shorting member.

The select conductive members to which the shorting member is coupled may be ground conductors. A shorting member included in the connector so as to electrically couple to the ground conductors may reduce resonances within the connector and therefore expand the operating frequency range of the connector. For example, when the connector is intended to operate at higher frequencies (e.g., 25 GHz, 30 GHz, 35 GHz, 40 GHz, 45 GHz, etc.), the presence of the shorting member may reduce resonances that may occur at the higher frequencies, thereby enabling reliable operation at the higher frequencies and consequently increasing the operating range of the connector.

The presence of a shorting member may expand the frequency range over which the connector may operate, without increasing the distance between conductive elements. In some embodiments, conducting structures of a receptacle connector may support resonant modes at a fundamental frequency within a frequency range of interest for operation of the connector. In that scenario, the shorting member may alter the fundamental frequency of the resonant mode, such that it occurs outside the frequency range of interest. Without the fundamental frequency of the resonant mode in the frequency range of interest, one or more performance characteristics of the connector may be at an acceptable level over the frequency range of interest, whereas, in the absence of the shorting member, the performance characteristic(s) would be unacceptable.

The frequency range of interest may depend on the operating parameters of the system in which such the connector is used, but may generally have an upper limit between about 15 GHz and 120 GHz, such as 25, 30, 40, or 56 GHz, although higher frequencies or lower frequencies may be of interest in some applications. Some connector designs may have frequency ranges of interest that span only a portion of this range, such as 1 GHz to 10 GHz, or 3 GHz to 15 GHz, or 5 GHz to 35 GHz.

The operating-frequency range for an interconnection system may be defined based on the range of frequencies that pass through the interconnection system with acceptable signal integrity. Signal integrity may be measured in terms of a number of criteria that depend on the application for which the interconnection system is designed. Some of these criteria may relate to the propagation of a signal along a single-ended signal path, a differential signal path, a hollow waveguide, or any other type of signal path. The criteria may be specified as a limit or range of values for performance characteristics. Two examples of such characteristics are the attenuation of a signal along a signal path, and the reflection of a signal from a signal path.

Other characteristics may relate to interaction of signals on multiple distinct signal paths. Such characteristics may include, for example, near-end cross talk, defined as the portion of a signal injected on one signal path at one end of the interconnection system that is measurable at any other signal path on the same end of the interconnection system. Another such characteristic may be far-end cross talk, defined as the portion of a signal injected on one signal path at one end of the interconnection system that is measurable at any other signal path on the other end of the interconnection system.

As specific examples of criteria, it could be required that: signal-path attenuation be no more than 3 dB of power loss, a reflected-power ratio be no greater than −20 dB, and individual signal-path to signal-path crosstalk contributions be no greater than −50 dB. Because these characteristics are frequency dependent, the operating range of an interconnection system may be defined as the range of frequencies over which the specified criteria are met.

Designs of an electrical connector are described herein that improve signal integrity for high-frequency signals, such as at frequencies in the GHz range, including up to about 56 GHz or up to about 120 GHz or higher, while maintaining a high density, such as with an edge to edge spacing between adjacent contacts (e.g., conductive elements) of approximately 0.25 mm or less, with a center-to-center spacing between adjacent contacts in a row of between 0.5 mm and 0.8 mm, for example. The contacts may have a width of between 0.3 mm and 0.4 mm for some types of contacts, and may have a width of between 0.65 mm and 0.75 mm for other types of contacts. As a specific example, the center-to-center spacing may be 0.6 mm for two adjacent contacts of a same type, and may be 0.75 mm for two adjacent contacts of different types.

The shoring member may be formed of a lossy material. Materials that conduct, but with some loss, or materials that by a non-conductive physical mechanism absorbs electromagnetic energy over the frequency range of interest may be referred to herein generally as "lossy" materials. Electrically lossy materials may be formed from lossy dielectric materials and/or poorly conductive materials and/or lossy magnetic materials.

Magnetically lossy materials may include, for example, materials traditionally regarded as ferromagnetic materials, such as those that have a magnetic loss tangent greater than approximately 0.05 in the frequency range of interest. The "magnetic loss tangent" is generally known to be the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest.

Electrically lossy materials may be formed from material traditionally regarded as dielectric materials, such as those that have an electric loss tangent greater than approximately 0.05 in the frequency range of interest. The "electric loss tangent" is generally known to be the ratio of the imaginary part to the real part of the complex electrical permittivity of the material. For example, an electrically lossy material may be formed of a dielectric material in which is embedded a conductive web that results in an electric loss tangent greater than approximately 0.05 in the frequency range of interest.

Electrically lossy materials may be formed from materials that are generally thought of as conductors, but are relatively poor conductors over the frequency range of interest, or contain conductive particles or regions that are sufficiently dispersed that they do not provide high conductivity, or are prepared with properties that lead to a relatively weak bulk conductivity compared to a good conductor (e.g., copper) over the frequency range of interest.

Electrically lossy materials typically have a bulk conductivity of about 1 siemen/meter to about 100,000 siemens/meter and preferably about 1 siemen/meter to about 10,000 siemens/meter. In some embodiments, material with a bulk conductivity of between about 10 siemens/meter and about 200 siemens/meter may be used. As a specific example, material with a conductivity of about 50 siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material may have a surface resistivity between 10 Ω/square and 1000 Ω/square. As a specific example, the electrically lossy material may have a surface resistivity of between about 20 Ω/square and 80 Ω/square.

In some embodiments, an electrically lossy material may be formed by adding to a binder a filler that contains conductive particles. In an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers, or other particles may also be used to provide suitable electrically lossy properties. Alternatively, combinations of fillers may be used. For example, metal-plated carbon particles may be used. Silver and nickel may be suitable metals for metal-plating fibers. Coated particles may be used alone or in combination with other fillers, such as carbon flakes. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, although the binder materials discussed above may be used to create an electrically lossy material by forming a matrix around conductive particle fillers, the present technology described herein is not so limited. For example, conductive particles may be impregnated into a formed matrix material or may be coated onto a formed matrix material, such as by applying a conductive coating to a plastic component or a metal component. As used herein, the term "binder" may encompass a material that encapsulates the filler, is impregnated with the filler or otherwise serves as a substrate to hold the filler.

In some embodiments, the fillers may be present in a sufficient volume percentage to allow conducting paths to be created from particle to particle. For example, when metal fiber is used, the fiber may be present at about 3% to 40% by volume. The amount of filler may impact the conducting properties of the material.

Filled materials may be purchased commercially, such as materials sold under the trade name Celestran® by Celanese Corporation, which can be filled with carbon fibers or stainless steel filaments.

A lossy member may be formed from a lossy conductive-carbon-filled adhesive preform, which may be obtained from Techfilm of Billerica, Mass., US, may be used as a lossy material. This preform may include an epoxy binder filled with carbon fibers and/or other carbon particles. The binder may surround carbon particles, which act as a reinforcement for the preform. Such a preform may be inserted in a connector lead frame subassembly to form all or part of the housing. In some embodiments, the preform may adhere through an adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated, may be used. For example, non-woven carbon fiber may be a suitable reinforcing fiber. As will be appreciated, other suitable reinforcing fibers may be used instead or in combination.

Alternatively, lossy member may be formed in other ways. In some embodiments, a lossy member may be formed by interleaving layers of lossy and conductive material such as metal foil. These layers may be rigidly attached to one another, such as through the use of epoxy or another adhesive, or may be held together in any other suitable way. The layers may be of the desired shape before being secured to one another or may be stamped or otherwise shaped after they are held together. Alternatively or additionally, a lossy material may be formed by depositing or otherwise forming a diffuse layer of conductive material, such as metal, over an insulative substrate, such as plastic, to provide a composite part with lossy characteristics, as described above.

In various example embodiments described herein, the shorting member may be formed of an electrically lossy material. In some specific examples, that lossy material may have a plastic matrix, such that members may be readily molded into a desired shape. The plastic matrix may be made partially conductive by the incorporation of conductive fillers, as described above, such that the matrix becomes lossy.

Aspects of the techniques and technology described herein may enable an electrical connector to have improved the integrity of signals over a higher range of frequencies, such as frequencies up to about 56 or 120 GHz or higher, while maintaining a small connector size. That is, the conductive elements of the connector may be maintained at a high density, such as an edge to edge spacing between adjacent conductive elements of approximately 0.25 mm or less, with a center-to-center spacing between adjacent contacts in a row of between 0.5 mm and 0.8 mm. The contacts may have a width of between 0.3 mm and 0.4 mm for some types of contacts, and may have a width of between 0.65 mm and 0.75 mm for other types of contacts.

Embodiment 1

According to a first embodiment, an electrical connector may be comprised of an insulative portion, a plurality of terminals supported by the insulative portion, and a lossy member. The terminals may be disposed in a row along a row direction. Each of the terminals may include a first end (or free distal end), a mounting end, and an intermediate portion joining the first end to the mounting end. The lossy member may include a body portion elongated in the row direction and a plurality of projections extending from the body portion toward the first ends of a plurality of first terminals of the terminals supported by the insulative portion. Each of the terminals may include a first surface and a second surface opposite the first surface, with the first surface including a first contact region thereon. The projections of the lossy member may be aligned with the second surfaces of the first terminals.

In an aspect of the embodiment, the projections of the lossy members may be configured to make contact with the second surfaces of the first terminals.

In an aspect of the embodiment, the insulative portion may be molded around first segments of the intermediate portions of the terminals. Second segments of the intermediate portions of the terminals may extend from the insulative portion, such that the projections of the lossy member may make contact with the second surfaces of the first terminals at locations on the second segments between the insulative portion and the first ends of the first terminals.

In an aspect of the embodiment, the mounting ends may include surface-mount contact tails.

In an aspect of the embodiment, the terminals may include the first terminals and a plurality of second terminals. Each of the second terminals may have a second width, and each of the first terminals may have a first width greater than the second width. The projections of the lossy member may be aligned with the second surfaces of the first terminals, and may be separated, in the row direction, from the second terminals.

In an aspect of the embodiment, the second terminals may include pairs of second terminals. Each of the pairs of second terminals may be separated from another of the pairs of second terminals by a first terminal.

In an aspect of the embodiment, the electrical connector is a receptacle connector. The first contact regions may include plug contact regions configured to make physical contact with corresponding plug terminals when a plug connector is mated with the receptacle connector.

In an aspect of the embodiment, the connector may be further comprised of an insulative member. The insulative member be comprised of a wall that includes a plurality channels. The first ends of the terminals and sections of the intermediate portions of the terminals may be disposed in the channels such that the first contact regions are exposed. The projections of the lossy member may include second contact regions disposed in first channels of the channels of the wall. The first channels may be configured to correspond to the first terminals. The second contact regions of the projections of the lossy member may be disposed in the first channels between the second surfaces of the first terminals and the insulative member.

In an aspect of the embodiment, the connector may be a receptacle connector in combination with a plug connector. The plug connector may include a plurality of mating terminals in contact with the terminals of the receptacle connector at first contact locations in the first contact regions. The mating terminals may apply a force to the first terminals that deflects the first ends of the first terminals, such that the first terminals are urged toward and physically contact the second contact regions of the projections of the lossy member at second contact locations.

In an aspect of the embodiment, the receptacle connector may be in combination with the plug connector such that, for the first terminals that are in physical contact with the projections of the lossy member at the second contact regions, the first contact locations and the second contact locations are within a predetermined distance from longitudinal midpoints of the first terminals.

In an aspect of the embodiment, the first terminals may be ground terminals. For each of the ground terminals, the first end may be angled, the mounting end may be angled, and the intermediate portion may be substantially straight and may be elongated in a direction perpendicular to the row direction. The longitudinal midpoint of each of the ground terminals may be a longitudinal midpoint of the intermediate portion.

In various aspects of the embodiment, the predetermined distance may be within about 1 mm, or within about 0.8 mm, or within about 0.6 mm, or within about 0.4 mm, or within about 0.2 mm.

In various aspects of the embodiment, the predetermined distance may be between about 0.2 mm and about 1 mm, or less than about 0.8 mm, or less than about 0.2 mm.

Embodiment 2

According to a second embodiment an electrical connector may include an insulative housing, a plurality of terminals, first and second terminal subassemblies, and a lossy member. The terminals may include a plurality of first terminals and a plurality of second terminals. The first terminal subassembly may be disposed in the housing and may be comprised of a first support bar. A first portion of the terminals may be attached to the first support bar. The second terminal sub assembly may be disposed in the housing and may be comprised of a second support bar. A second portion of the terminals may be attached to the second support bar. The lossy member may be disposed in the housing and may be comprised of a body portion and a plurality of projections that extend from the body portion. The first and second support bars may be elongated in a first direction, and the body portion of the lossy member may be disposed between the first and second support bars. Each of the terminals may include an intermediate portion extending from the first support bar or the second support bar. Each intermediate portion of the terminals may be elongated in a second direction perpendicular to the first direction, and the projections of the lossy member may extend from the body portion in the second direction. The projections of the lossy member may include a plurality of contact portions that extend towards the intermediate portions of the first terminals, in a direction perpendicular to the first direction and perpendicular to the second direction. Each of the first and second terminal subassemblies may include a subset of the first terminals and a subset of the second terminals.

In an aspect of the embodiment, each of the projections of the lossy member may be L-shaped.

In an aspect of the embodiment, the first terminals may include ground terminals, and the second terminals may include pairs of signal terminals. The pairs of signal terminals and the ground terminals may be arranged in an alternating pattern on the first and second support bars, such that no two pairs of the pairs of signal terminals are adjacent each other. The contact portions of the projections of the lossy member may extend towards the intermediate portions of the ground terminals.

In an aspect of the embodiment, each of the terminals may include a mounting end and a free distal end sandwiching the intermediate portion in between. The mounting ends may be configured to be fixedly mounted to a circuit board, and the free distal ends may be movable relative to the mounting ends.

In an aspect of the embodiment, each of the terminals may include a first surface and a second surface, opposite the first surface. The first surface may include a first contact surface. The contact portions of the projections of the lossy member that extend towards the intermediate portions of the first terminals may be positioned adjacent the second surfaces of the first terminals.

In an aspect of the embodiment, the connector may be a receptacle connector. The insulative housing may include a plug-receiving opening and at least one wall with a surface facing into the opening. The terminals may be arranged such that the first surfaces face into the opening and the free distal ends extend into channels in the at least one wall.

In an aspect of the embodiment, the at least one wall may include first and second walls. The channels may be disposed in the first and second walls. The terminals may be configured such that the free distal ends are disposed within the channels, and the contact portions of the projections of the lossy member that extend towards the intermediate portions of the first terminals may be positioned adjacent the second surfaces of the first terminals and may be within corresponding ones of the channels.

In an aspect of the embodiment, each of the first support bar of the first terminal subassembly, the second support bar of the second terminal subassembly, and the body portion of the lossy member may have a first end and a second end. The body portion of the lossy member may be elongated in the first direction and may have a length that is longer than a length of the first support bar and longer than a length of the second support bar. The first end of the body portion of the lossy member may be substantially aligned with the first end of the first support bar, and a second end of the body portion of the lossy member may be substantially aligned with the second end of the second support bar, such that the first end of the body portion of the lossy member may extend beyond the first end of the second support bar, and such that the second end of the body portion of the lossy member may extend beyond the second end of the first support bar.

In an aspect of the embodiment, the body portion of the lossy member may include a first side on which the first terminal subassembly is arranged and a second side on which the second terminal subassembly is arranged. The projections of the lossy member may include first projections arranged on the first side of the body portion and second projections arranged on the second side of the body portion. An arrangement of the first projections on the first side of the body portion relative to an arrangement of the second projections on the second side of the body portion may be staggered in the first direction.

In an aspect of the embodiment, the arrangement of the first projections and the arrangement of the second projections are such that no two projections of the projections of the lossy member share a common longitudinal position along the body portion of the lossy member.

In an aspect of the embodiment, the connector may be a receptacle connector in combination with a plug connector. The plug connector may include a plurality of mating terminals in contact with the terminals of the receptacle connector at first contact locations in the first contact regions. The mating terminals may apply a force to the terminals of the receptacle connector that may deflect the free distal ends of the terminals of the receptacle connector, such that the first terminals of the receptacle connector may be urged toward and physically contact the contact portions of the projections of the lossy member at second contact locations on the second surfaces of the first terminals of the receptacle connector.

In an aspect of the embodiment, the receptacle connector may be in combination with the plug connector such that, for the first terminals of the receptacle connector that are in physical contact with the projections of the lossy member at the second contact locations, the first contact locations and the second contact locations may be within a predetermined distance from a longitudinal midpoint of the first terminals.

In various aspects of the embodiment, the predetermined distance may be within about 1 mm, or within about 0.8 mm, or within about 0.6 mm, or within about 0.4 mm, or within about 0.2 mm.

In various aspects of the embodiment, the predetermined distance may be between about 0.2 mm and about 1 mm, or less than about 0.8 mm, or less than about 0.2 mm.

In an aspect of the embodiment, the first terminals may be ground terminals. For each of the ground terminals, the intermediate portion may be located between an angled first end and an angled second end. A longitudinal midpoint of each of the ground terminals may be a longitudinal midpoint of the intermediate portion.

In an aspect of the embodiment, for each of the ground terminals, the intermediate portion may be substantially straight.

Embodiment 3

According to a third embodiment, a method of operating an electrical connector may include aligning the electrical connector with a mating electrical connector such that first terminals of the electrical connector align with second terminals of the mating electrical connector. The method also may include pressing the electrical connector and the mating electrical connector together such that: contact points between the first terminals and the second terminals slide in a direction from a first end of the first terminals towards a second end of the first terminals, and the first terminals deflect so as to increase a contact force between the first terminals and electrically interconnected lossy members.

In an aspect of the embodiment, the first terminals may be held by an insulative portion of the electrical connector at anchor points that are a first distance from the second end of the first terminals. When the first terminals deflect, the first terminals may contact the interconnected lossy members at first contact points that are a second distance from the second end of the first terminals. The second terminals may contact the first terminals at second contact points that are a third distance from the second end of the first terminals. The third distance may be greater than the second distance, and the second distance may be greater than the first distance.

In an aspect of the embodiment, when the first terminals deflect, the contact force between the first terminals and the electrically interconnected lossy members may increase from 0 to in excess of 10 Newtons.

Turning now to the figures, FIG. 1 depicts an example of a mated pair 1 of electrical connectors that includes a receptacle connector 100 and a plug connector 200 connected together in an engaged or mated state, according to various embodiments of the present technology. A plurality of cables 300 extend from the plug connector 200.

Such a pair of connectors may be used, for example, in an electronic assembly with a flyover configuration. The receptacle connector 100 may be mounted at an interior portion of a printed circuit board next to a processor, switch, or other high-performance electronic component. The cables 300 may be connected to or near an I/O connector mounted at the edge of the printed circuit board. In this way, the pair of connectors may provide high-integrity signal paths between the I/O connector and the high-performance electronic component. In such an embodiment, improving the performance of the connectors using techniques as described herein may improve the performance of the electronic assembly.

Figure 2:
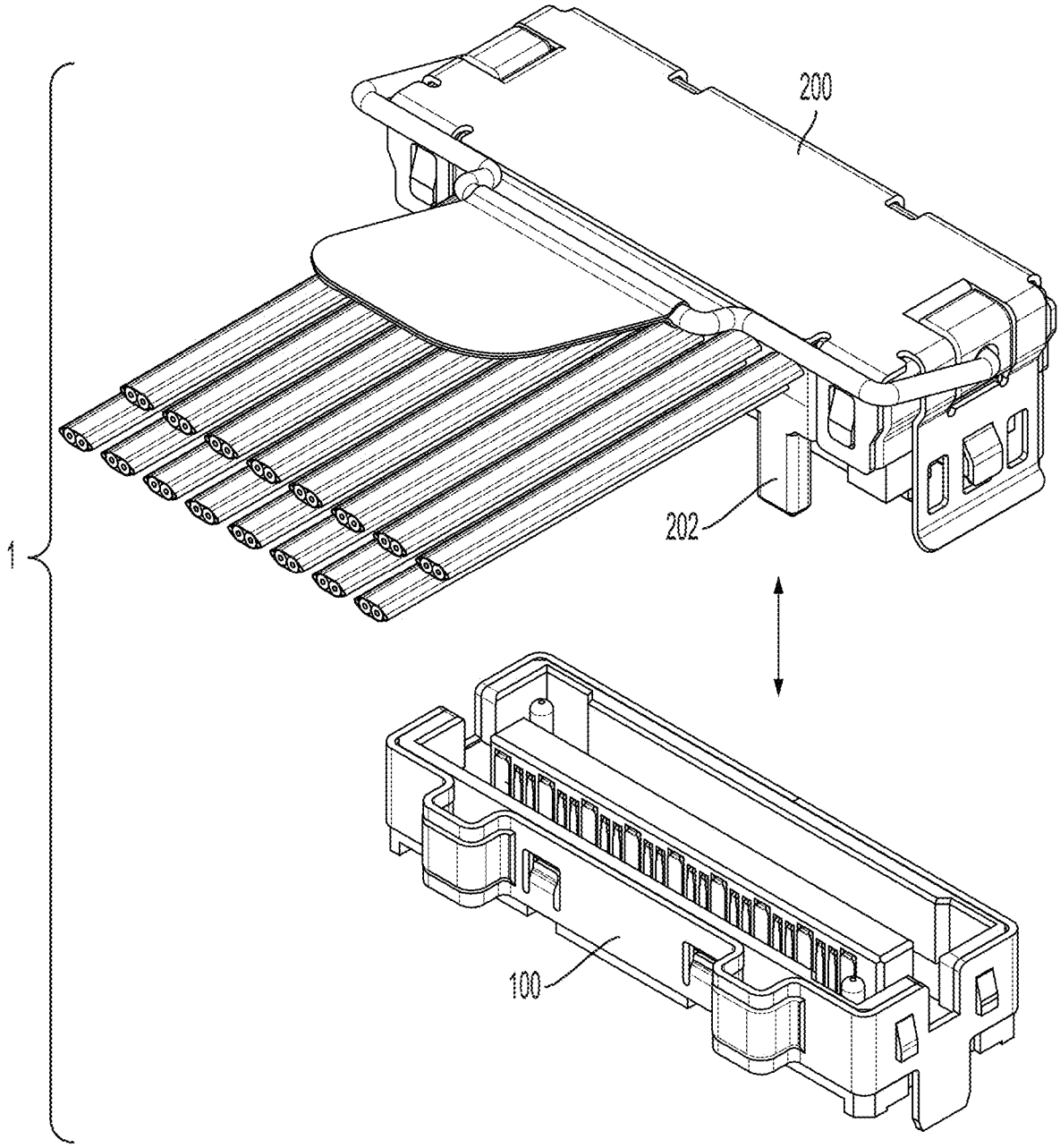
FIG. 2 is a top perspective view of the plug connector and the receptacle connector of FIG. 1 in a disengaged state, in accordance with some embodiments of the present technology.

FIG. 2 depicts the receptacle connector 100 disengaged from the plug connector 200. The double-headed arrow in FIG. 2 shows the engagement and disengagement directions of the mated pair 1.

The mated pair 1 depicted in FIG. 1 provides a low-profile connection by having the cables 300 extend perpendicularly from an engagement direction of the plug connector 200 with the receptacle connector 100. In this regard, the plug connector 200 may be considered a right-angle plug connector 200. As will be appreciated, the receptacle connector 100 may engage with a different type of plug connector when a low profile is not necessary or desired. For example, the receptacle connector 100 may engage with a plug connector in which cables extend parallel to the engagement direction. Alternatively or additionally, the receptacle may have other configurations. For example, intermediate portions of conductive terminals within receptacle connector 100 may bend at a right angle such that the mating interface of connector 100 is perpendicular to a printed circuit board to which the connector is mounted, rather than parallel to the printed circuit board as shown in the configuration of FIG. 2.

Figure 3:
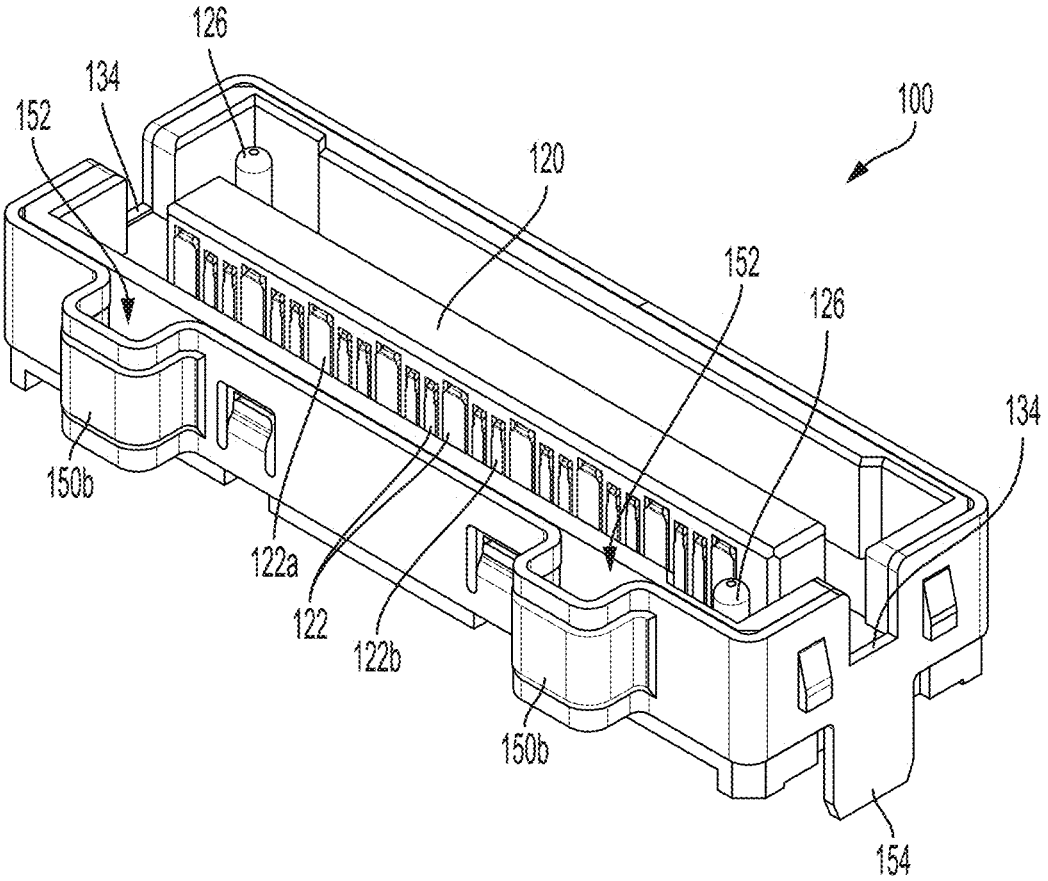
FIG. 3 is a top perspective view of the receptacle connector of FIGS. 1 and 2.
Figure 4:
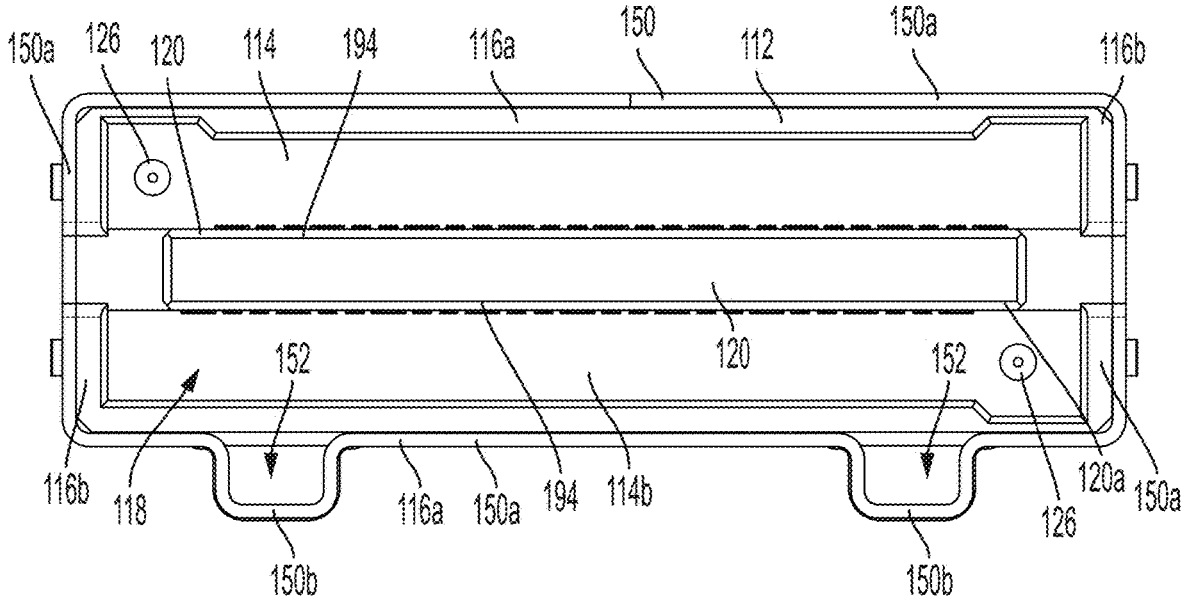
FIG. 4 is a top plan view of the receptacle connector of FIG. 3.
Figure 5:
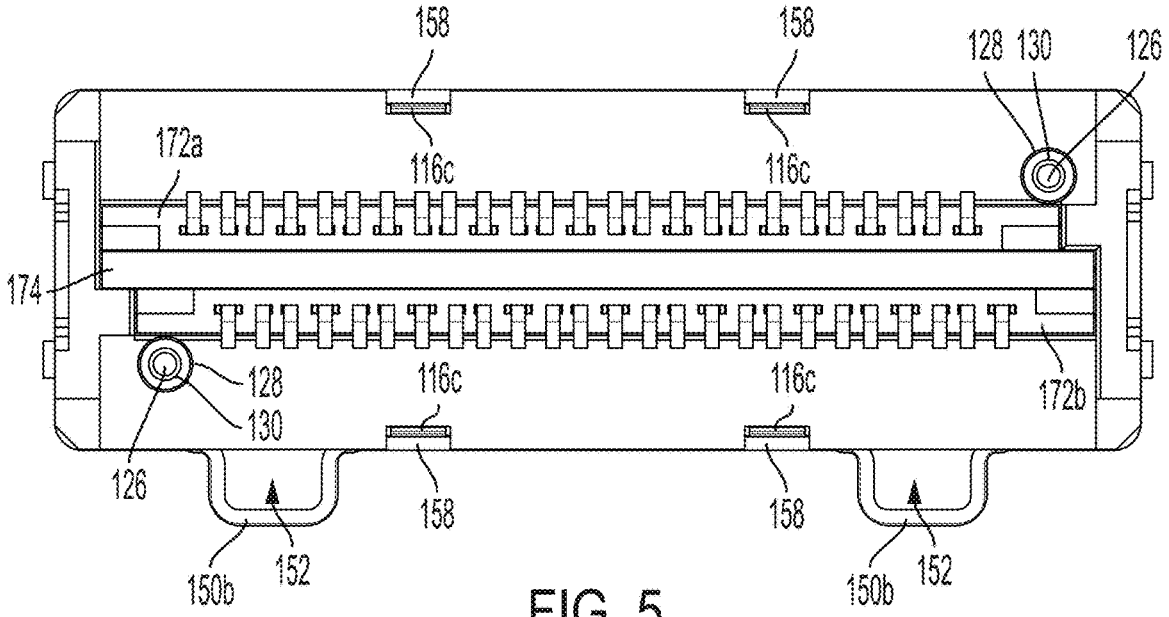
FIG. 5 is a bottom plan view of the receptacle connector of FIG. 3.
Figure 6A:
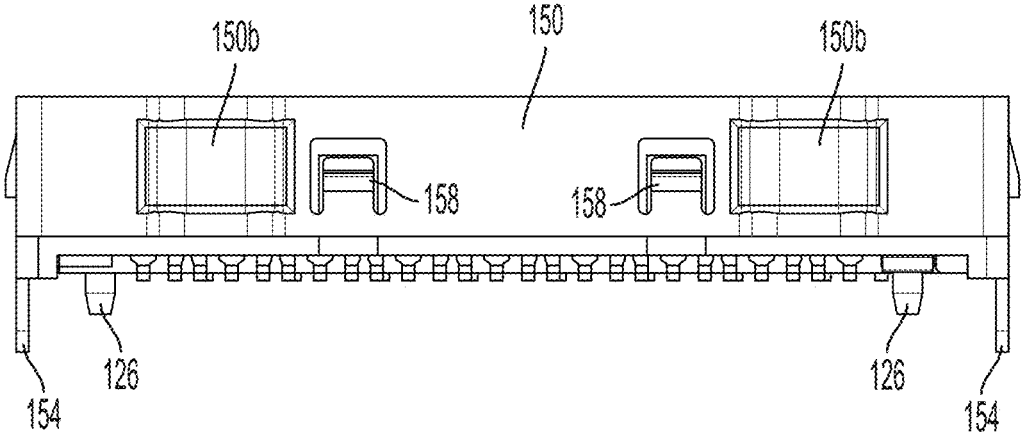
FIGS. 6A and 6B are front and back elevational views of the receptacle connector of FIG. 3.
Figure 6B:
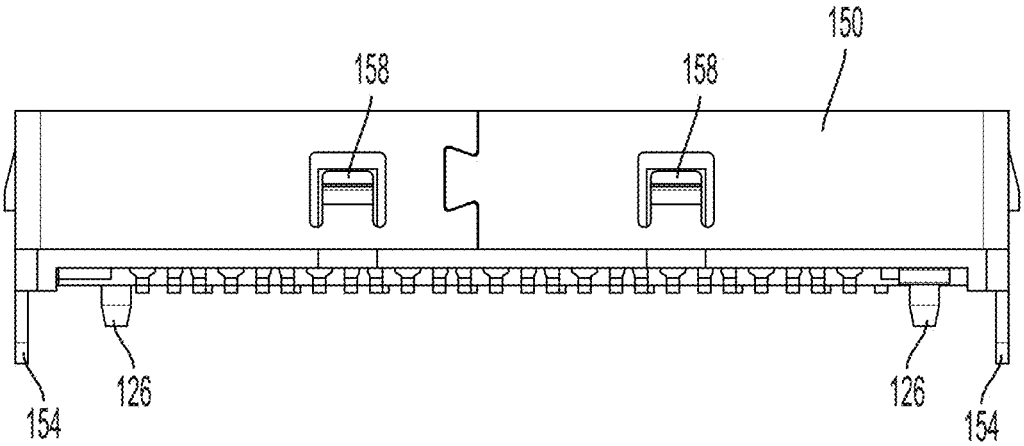
Figure 7A:
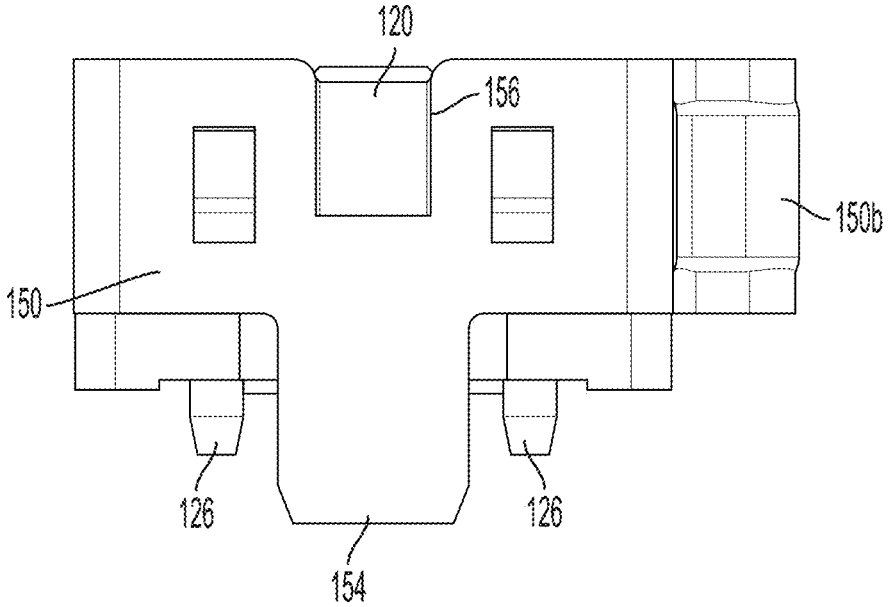
FIGS. 7A and 7B are left-side and right-side elevational views of the receptacle connector of FIG. 3.
Figure 7B:
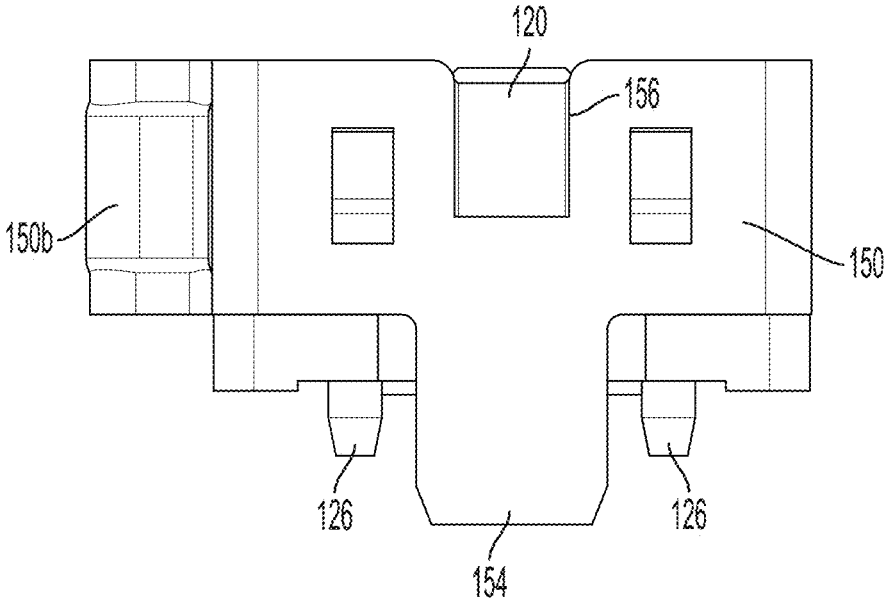
Figure 8:
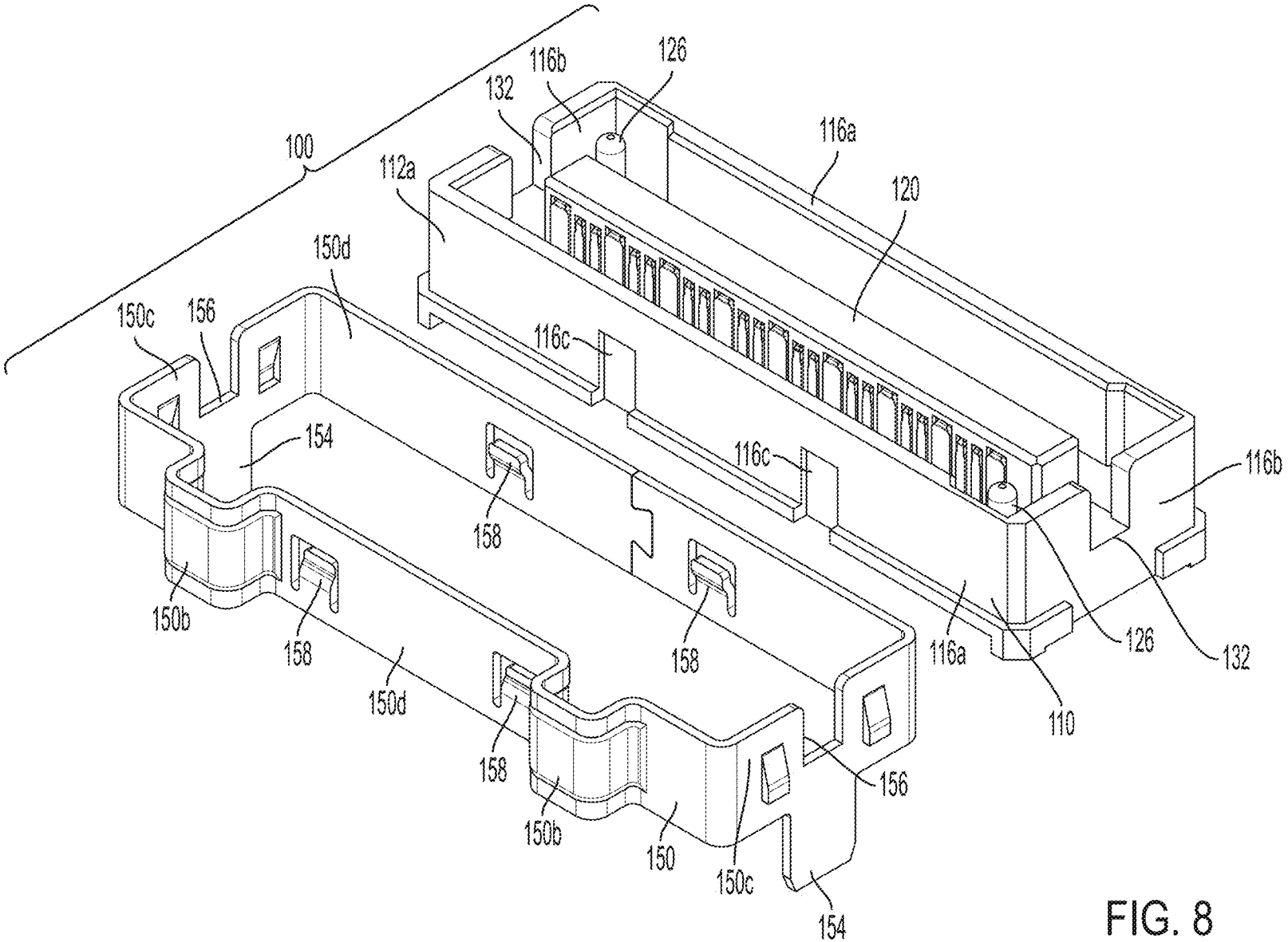
FIG. 8 is a top perspective view of the receptacle connector of FIG. 3, in a partially disassembled state.
Figure 9:
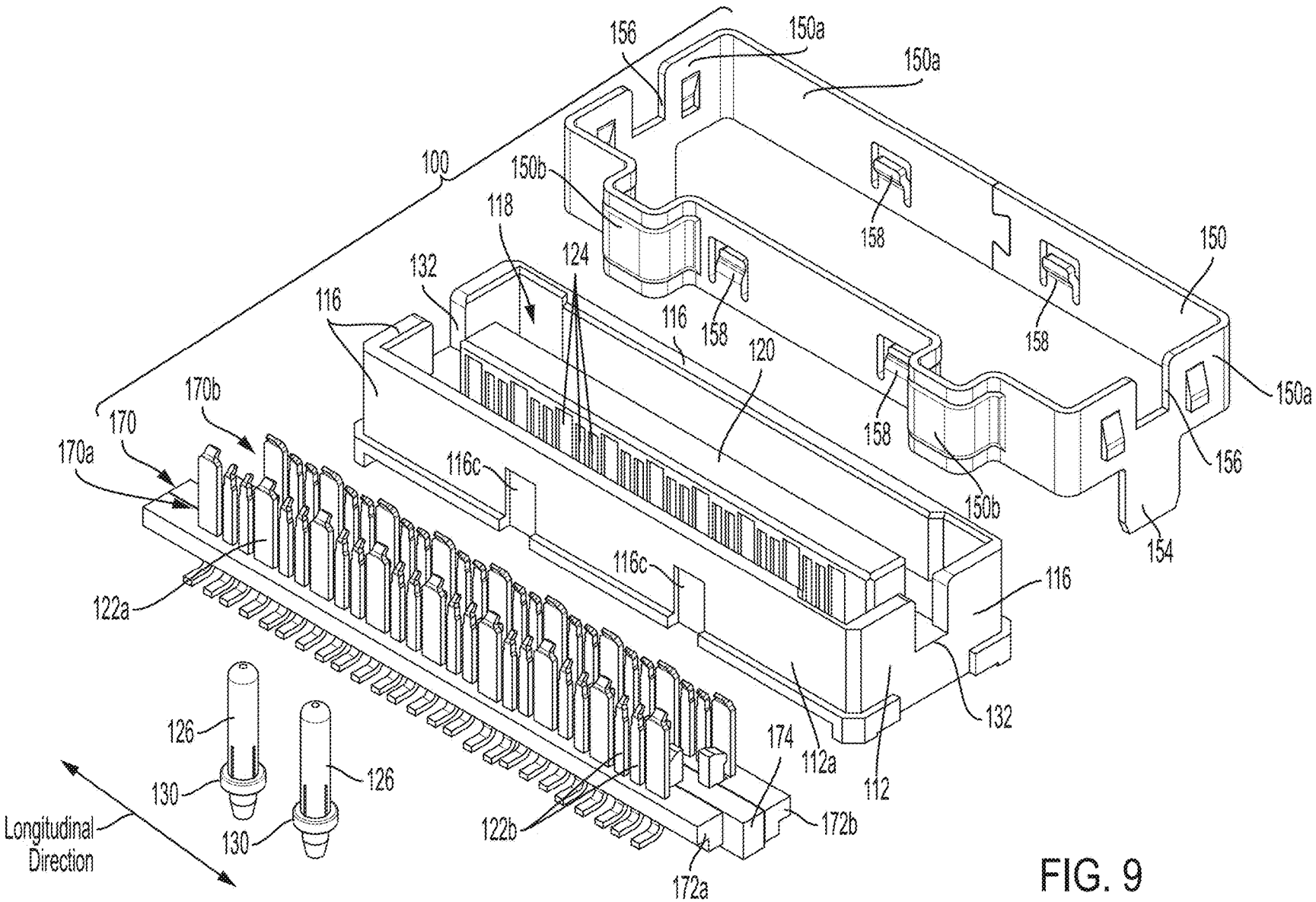
FIG. 9 is a top perspective view of the receptacle connector of FIG. 3, in a partially disassembled state.

FIG. 3 shows a perspective view of the receptacle connector 100. FIGS. 4 and 5 show, respectively, top and bottom plan views of the receptacle connector 100. FIGS. 6A and 6B, respectively, show front and back elevational views of the receptacle connector. FIGS. 7A and 7B, respectively, show right-side and left-side elevational views of the receptacle connector 100. FIGS. 8 and 9 show the receptacle connector 100 in different states of disassembly.

The receptacle connector 100 may include a housing assembly 110 (FIG. 8) and a shell 150. The housing assembly 110 may include an insulative housing 112 having a bottom 114 and a wall 116 extending from a periphery of the bottom 114. The bottom 114 and the wall 116 define an opening or interior 118 of the housing 112.

For example, the wall 116 may extend perpendicularly from the bottom 114 of the housing 112. The bottom 114 may have a generally rectangular shape, such that the wall 116 may have two longer sides 116*a* and two shorter sides 116*b*.

An island 120 may extend from the bottom 114 into the interior 118 of the housing 112, and may be structured to accommodate a plurality of elongate terminals 122 that include ground terminals 122*a* and signal terminals 122*b*. The island 120 may include two major surfaces 120*a* respectively facing the two longer sides 116*a* of the wall 116. One or both of the major surfaces 120*a* may include channels or slots 124 through which portions of the terminals 122 may be exposed.

The insulative portions of housing assembly 110 may, in some embodiments, be integrally formed, such as through molding plastic. In other embodiments, some portions of the housing assembly 110 may be separately formed.

At least one guide post 126 may extend from the bottom 114 into the interior 118 of the housing 112, and may be spaced apart from the wall 116 and the island 120. In the figures, two guide posts 126 are shown and therefore the following discussion may refer to "first and second" guideposts. However, it should be understood that the present technology may encompass a single guide post or more than two guide posts.

In the illustrated embodiment, guide posts 126 may be formed of metal. The guide posts 126 may extend through corresponding holes 128 in the bottom 114 of the housing 112. The guide posts 126 may each include a ledge portion 130 that abuts against an exterior surface 114*a* opposite an interior surface 114*b* of the bottom 114. The guide posts 126 may be formed of metal or another rigid material.

Figure 11:
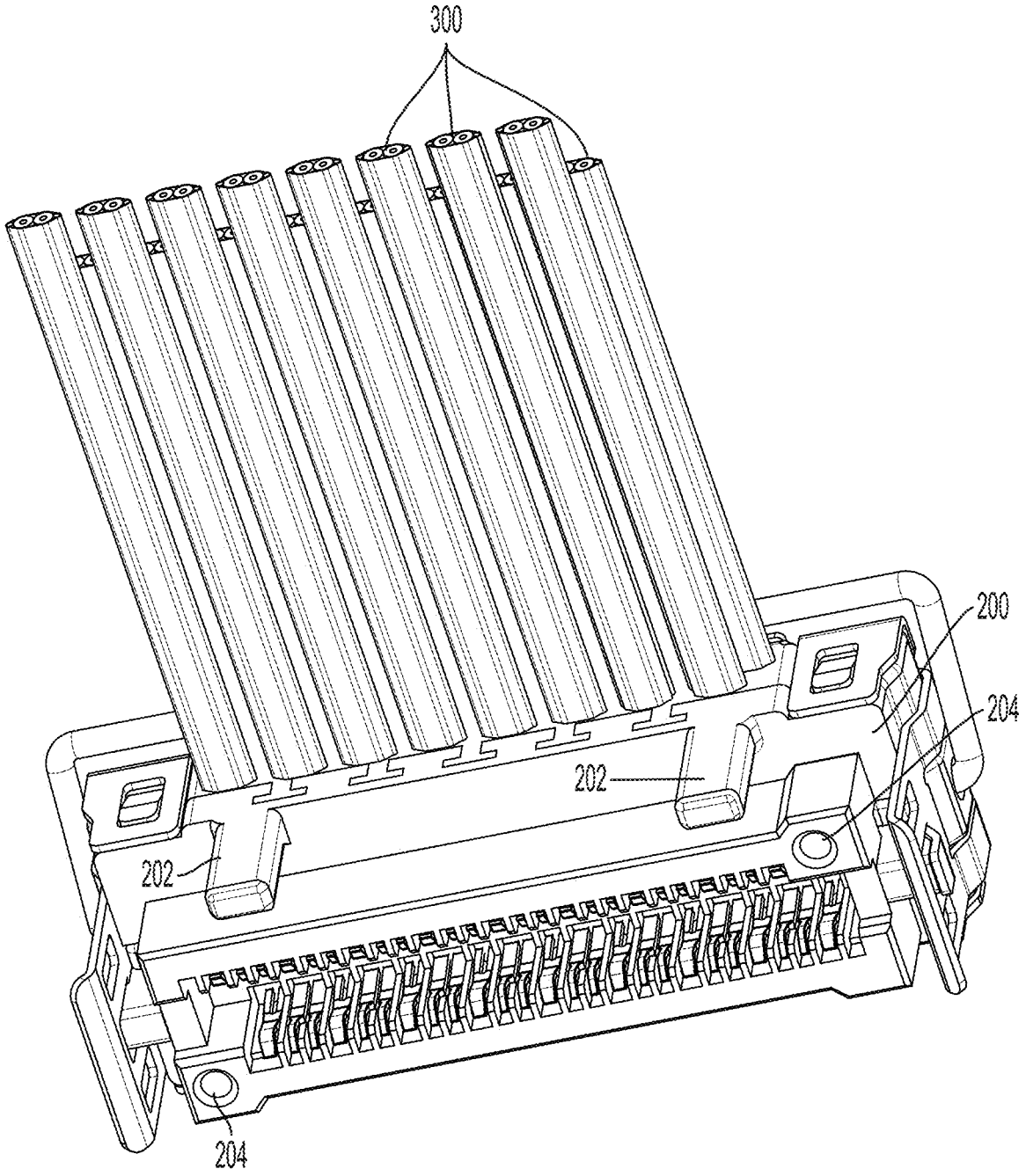
FIG. 11 is a bottom perspective view of the plug connector of FIG. 2.

The guide posts 126 may be structured or configured to be received in corresponding guide holes 204 in a plug connector 200, as shown in FIG. 11. In a mating operation between the receptacle connector 100 and a plug connector 200, alignment with the guide posts 126 occurs before the plug connector 200 makes physical contact with the island 120. Thus, the guide posts 126 may prevent damage to the island 120, the terminals 122 supported by the island 120, and/or other parts of the housing 112 by deterring misalignment of the plug connector 200 with the receptacle connector 100 during a mating operation.

As shown in FIG. 4, the interior or opening 118 of the housing 112 may have a longer dimension parallel to the longer side 116*a* of the wall 116, and a shorter dimension orthogonal to the longer dimension and parallel to the shorter side 116*b* of the wall 116. The island 120 may be elongate along the longer dimension of the interior 118 of the housing 112. The guide posts 126 may be located between an end of the island 120 and an adjacent portion of the wall 116. For example, the guide posts 126 may be disposed in the housing 112 at or near diagonally opposite corners of the housing 112, respectively between diagonally opposite corners of the island 120 and diagonally opposite corners of the wall 116.

The shell 150 of the receptacle connector 100 may be configured to surround an outer surface 112*a* of the housing 112. The shell 150 may include at least one conforming portion 150*a*, which conforms with and is adjacent the outer surface 112*a* of the housing 112. The shell 150 may include at least one spaced-apart portion 150*b*, which is separated or spaced apart from the outer surface 112*a* of the housing 112, and which defines a space 152.

In some embodiments, shell 150 may be formed of metal. For example, shell 150 may be made from a sheet of metal, which features stamped and then formed to the illustrated shapes. In other embodiments, shell 150 may be formed of more than one component.

The figures show the shell 150 to include two spaced-apart portions 150*b*. It should be understood, however, that in various other embodiments of the present technology the shell 150 may have one spaced-apart portion 150*b* or more than two spaced-apart portions 150*b*.

Figure 10:
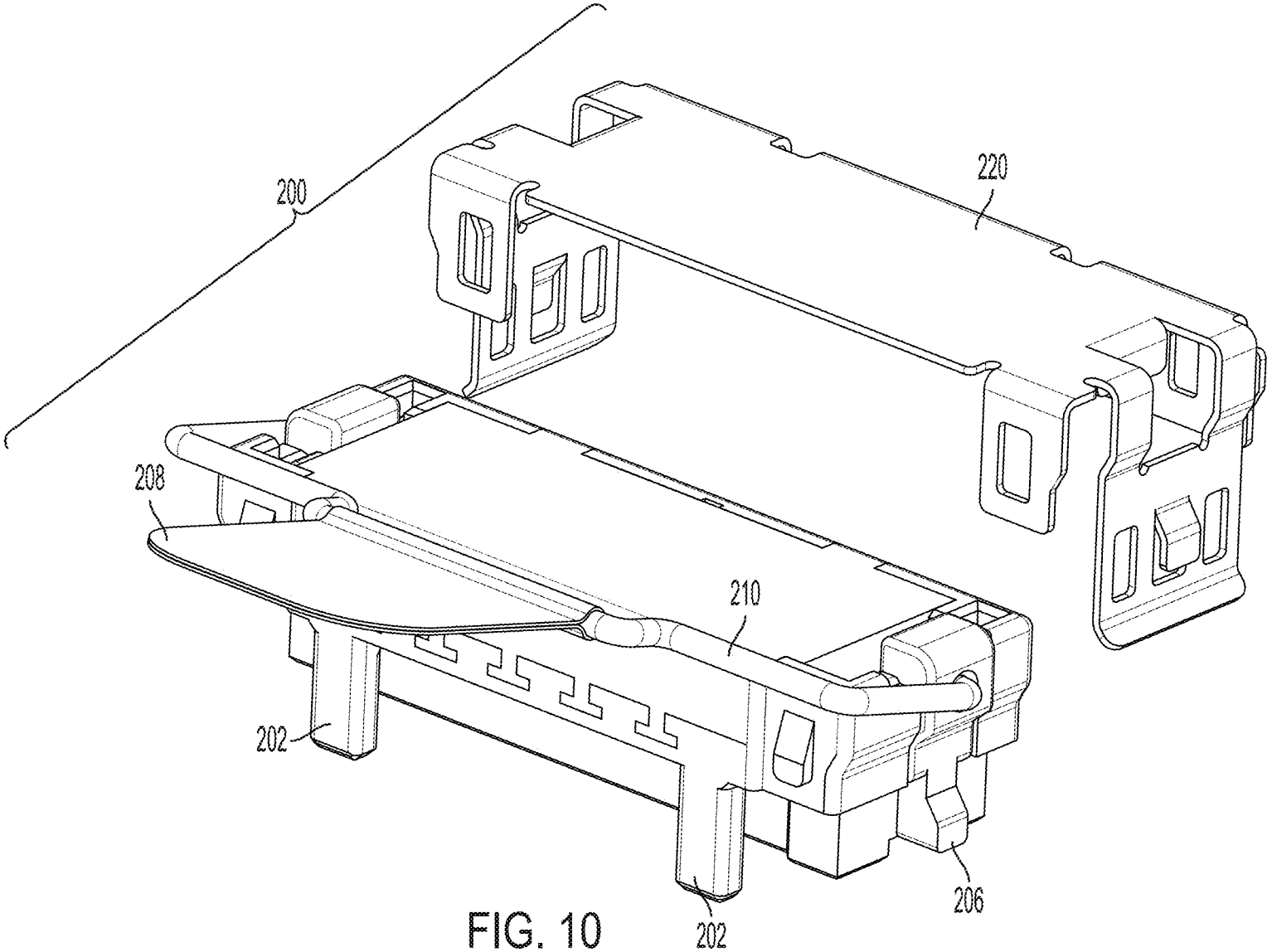
FIG. 10 is a top perspective view of the plug connector of FIG. 2, in a partially disassembled state.

The spaces 152 defined by the spaced-apart portions 150*b* of the shell 150 may be structured to receive protrusions of a plug connector 200. For example, as shown in FIGS. 10 and 11, the plug connector 200 may include legs 202 arranged to be inserted in the spaces 152 in a mating operation between a plug connector 200 and the receptacle connector 100. The spaced-apart portions 150*b* of the shell 150 may enable the plug connector 200 to achieve a general alignment with the housing assembly 110 during an initial part of the mating operation. For example, the legs 202 of the plug connector 200 may be configured to align with and be inserted in the spaces 152 defined by the shell 150 before or simultaneously with alignment of the guide posts 126 with corresponding guide holes of the plug connector 200.

The conforming portion 150*a* of the shell 150 may have two shorter sides 150*c* adjacent the two shorter sides 116*b* of the wall, and may have two longer sides 150*d* adjacent to the two longer sides 116*a* of the wall 116. The conforming portion 150*a* may conform with the outer surface 112*a* of the housing 112 except at the spaced-apart portions 150*b*, which may be disposed along one or both of the two longer sides 150*d* of the shell 150. Optionally, the spaced-apart portions 150*b* may be disposed along one or both of the two shorter sides 150*c* of the shell 150, or along any combination of the two longer sides 150*d* and the two shorter sides 150*d*.

A projection tab 154 may extend from each of the two shorter sides 150*c* of the shell 150. The projection tabs 154 may be configured to connect with or be attached to a circuit board (not shown) on which the receptacle connector 100 is to be mounted.

One or both of the two shorter sides 116*b* of the wall 116 may include a notch 132 that extends through a thickness of the wall 116. One or both of the two shorter sides 150*c* of the shell 150 may include a notch 156 that extends through a thickness of the shell 150. The notches 132, 156 may be aligned to form a collective notch 134 in the receptacle connector 100. The collective notch 134 may be aligned with the island 120.

For example, in FIG. 3, the receptacle connector 100 is shown to include two collective notches 134. The collective notches 134 may be configured to receive alignment tabs 206 of a plug connector 200 respectively therein. FIG. 10 is a perspective view of the plug connector 200 showing one such alignment tab 206.

The alignment tabs 206 may be connected to a pull tab 208 via a handle 210 having angled ends that are pivotably attached to the alignment tabs 206, as depicted in FIG. 10. The pull tab 208 may be rotatably attached to the handle 210 such that the pull tab 208 may rotate about an axis of the handle 210. During a mating operation, the handle 210 may be pivoted to a position perpendicular to an axial position of the cables 300, to enable a user to hold and manipulate the plug connector 200 into place relative to the receptacle connector 100. Once the plug connector 200 and the receptacle connector 100 are mated together, the handle 210 may be pivoted to a position parallel to the axial position of the cables 300, such that the handle 210 does not add to a vertical height of the plug connector 200 and therefore does not adversely affect the low profile of the mated pair 1. During a detachment operation, a user may press down on the pull tab 208 (e.g., press the pull tab 208 onto the cables 300), which may cause the angled ends of the handle 210 to urge the alignment tabs 206 in a direction vertically away from the receptacle connector 100, to dislodge the plug connector 200 without applying any misoriented pressure on the receptacle connector 100 and/or the plug connector 200.

In FIG. 10, a plug shell 220 is shown separately from a plug body 230 of the plug connector 200, in order to show details of the plug body 230. As evident from FIGS. 1 and 10, the plug shell 220 may be configured to fit over the plug body 230.

The wall 116 may include a plurality of recessed portions 116*c* that are configured to receive a plurality of latching portions 158 on the shell 150, in order to hold the shell 150 and the housing 112 together. For example, the recessed portions 116*c* may be disposed on the two longer sides 116*a* of the wall 116, and the latching portions 158 may be disposed on the two longer sides 150*d* of the shell 150. When the shell 150 and the housing 112 are assembled together, the latching portions 158 may latch into the recessed portions 116*c* to make snap-fit connections and prevent movement of the shell 150 relative to the housing 112. The recessed portions 116*c* may be formed partially or completely through a thickness of the wall 116. The shell 150 may be formed of metal, and the latching portions 158 may be portions of the shell 150 that are cut and bent to form springy tabs or latches that engage with the recessed portions 116*c*.

Figure 12A:
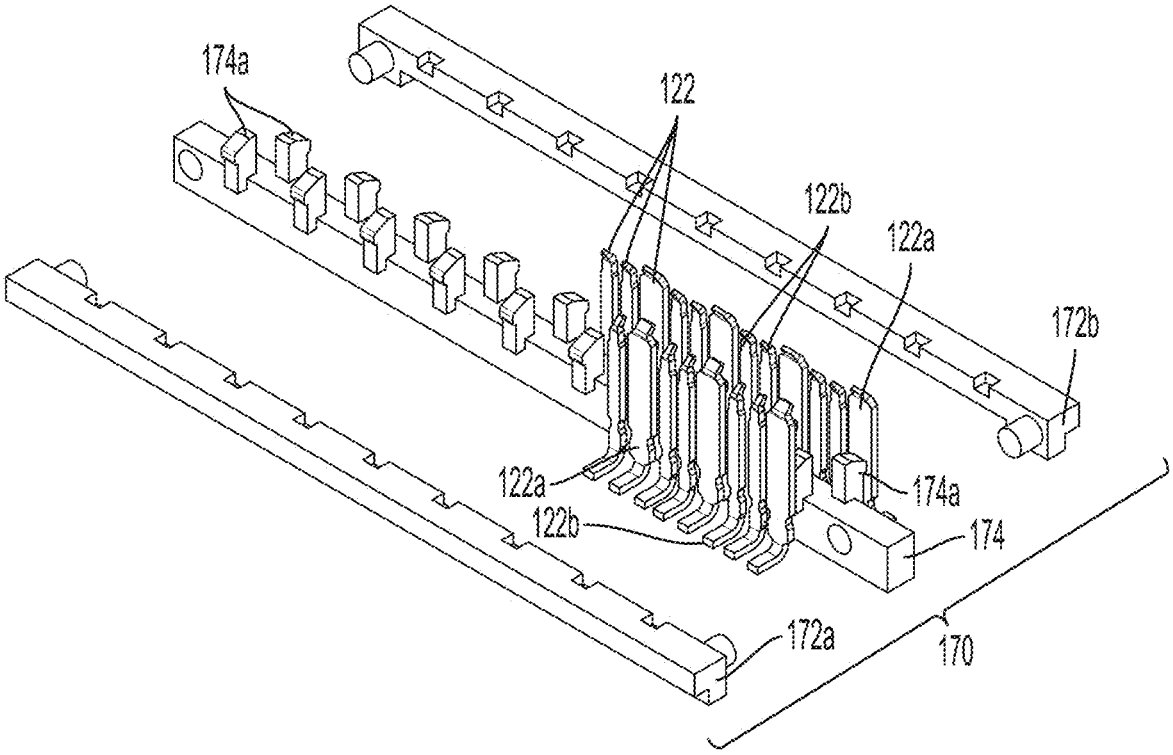
FIG. 12A is a partially exploded view of a portion of the receptacle connector of FIG. 2, showing parts of a terminal assembly that includes two terminal subassemblies.
Figure 12B:
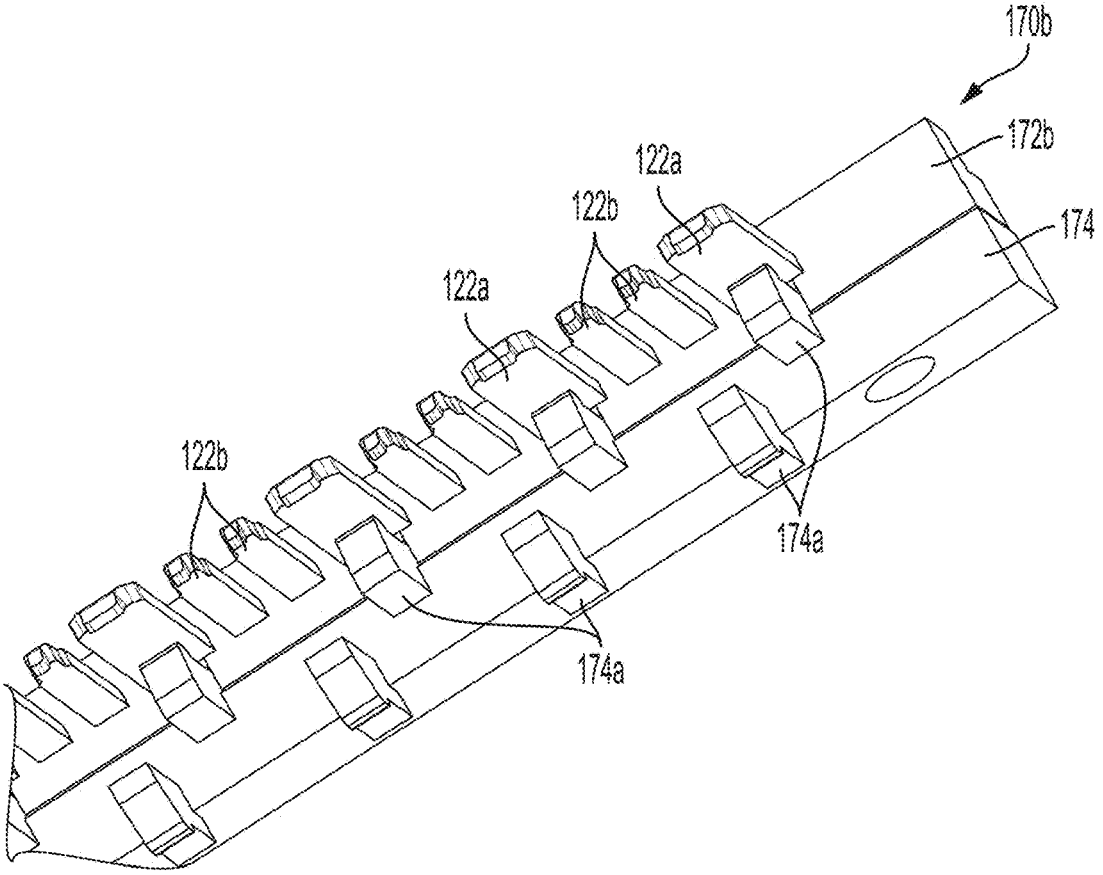
FIG. 12B is a perspective (non-exploded) view of a portion of the terminal assembly of FIG. 12A.

The receptacle connector 100 may include a terminal assembly 170 on which the terminals 122 are arranged in first and second terminal subassemblies 170*a*, 170*b*, as depicted in FIG. 9. FIG. 12A shows a partially exploded view of the terminal assembly 170, with some of the terminals 122 hidden to reveal various structural aspects of the terminal assembly 170. FIG. 12B shows a perspective (non-exploded) view of a portion of the terminal assembly 170.

The terminal assembly 170 may include first and second terminal bars 172*a*, 172*b* and a lossy member 174. For example, the lossy member 174 may be elongated in a longitudinal or row direction X of the terminal assembly 170. That is, each of the first and second terminal subassemblies 170*a*, 170*b* may include a group of terminals 122 arranged in a row, with the row direction X corresponding to the direction of the rows of terminals 122 of the two terminal subassemblies 170*a*, 170*b*. The first and second terminal bars 172*a*, 172*b* may be formed of an insulative material, and the lossy member 174 may be formed of a lossy material.

Each terminal 122, which may be a ground terminal 122*a* or a signal terminal 122*b*, may be formed of a conductive material such as metal, and may have a mounting portion 122*c*, an intermediate portion 122*d*, and a contact end 122*e*. The mounting portion 122*c*, which may be hooked relative to the intermediate portion 122*c*, may be configured to be mounted to a circuit board by, for example, a solder-mounting technique or another bonding technique. The contact end 122*e* may be hooked relative to the intermediate portion 122*d*.

In various embodiments, the first and second terminal bars 172*a*, 172*b* are made of a plastic material, and the plastic material may be molded around the terminals 122 during formation of the first and second terminal subassemblies 170*a*, 170*b*. For example, as shown in FIG. 12B, the terminals 122 of the second terminal subassembly 170*b* may be embedded in and extend from the second terminal bar 172*b*. However, other means for holding the terminals in a row may be used, such as pressing the terminals into slots in the terminal bars or compressing the terminals between insulative components.

Projections 174*a* of the lossy member 174 may be arranged to contact the ground terminals 122*a* but not the signal terminals 122*b*.

The hooked portion of the contact ends 122*e* may catch on interior surfaces of channels 124, retaining the distal tips of the terminals 122 in the channels 124. The terminals 122 may be bent such that contact surfaces of intermediate portions 122*d* are biased to extend out of the channels 124 where they are accessible for mating with complementary terminals of a mating connector. The contact surfaces of the intermediate portions 122*d* may be fully or partially plated with a noble metal, such as gold, or another suitable metal or alloy to provide a low-resistance contact with a complementary terminal of a mating connector. In some embodiments, a plating may be selectively provided over portions of the intermediate portions 122*d* over which the complementary terminals wipe or slide during connector mating.

In some embodiments, both the signal terminals 122*b* and the ground terminals 122*a* may have a plating on first surfaces configured for mating with complementary terminals of a mating connector. Those first surfaces may face outward from the island 120 in the assembled connector 100. Second surfaces of the terminals 122*a*, 122*b*, opposite the first surfaces, optionally may also be plated to provide contact surfaces in some embodiments. In various embodiments, the second surfaces of at least the ground terminals 122*a* may be plated to provide contact surfaces for making contact to projections 174*a* of the lossy member 174, as discussed below and illustrated in FIG. 16.

Figure 13:
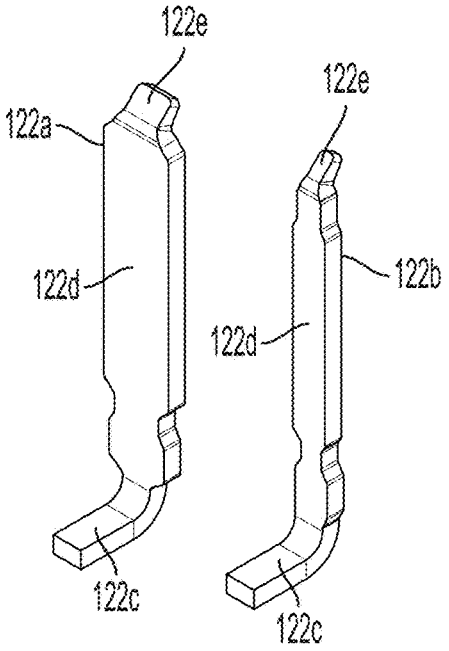
FIG. 13 is a perspective view of terminals of the terminal assembly of FIG. 12A.

In FIG. 13, the contact ends 122*e* are shown to be hooked in a first direction relative to the intermediate portions 122*d*, and the mounting portions 122*c* are shown to be hooked in a second direction generally opposite to the first direction. It should be appreciated that the configurations shown in FIG. 13 are merely examples, and the terminals 122*a*, 122*b* may have other configurations than those shown. For example, signal and/or ground terminals may have contact mounting portions 122*c* of other shapes to support other configurations. The contact mounting portions 122*c*, for example, may be shaped as press-fits for insertion into holes in a printed circuit board or may be shaped for terminating a wire in embodiments in which the connector 100 is configured for use in a cable assembly.

In various embodiments, the mounting portion 122*c* may be considered a fixable end of the terminal 122, because the mounting portion 122*c* may be fixable to a printed circuit board (not shown). In contrast, the contact end 122*e* may be a distal free end of the terminal 122, because the contact end 122*e* is not constrained but instead may move in response to a force applied to various portions of the terminal 122, including a force applied by a plug connector 200 mated which the receptacle connector 100 in which the terminal 122 is disposed.

In some embodiments, the channels 124 may have a depth that enables the distal free ends 122*e* to be recessed into the channels 124 in response to such a mating force. At least segments of the intermediate portions 122*d*, such as those segments between the insulative terminal bar 172*a* (or 172*b*) securing the terminals 122 and the tips of the distal free ends 122*e*, may be similarly deflected into the channels 124. The depth of the channels, for example, may be greater than the thickness of the terminals 122 to enable the terminals 122 to be recessed into the channel 124. In embodiments in which the lossy member 174 has contact surfaces positioned adjacent to some or all of the terminals 122 (e.g., the ground terminals 122*a*), deflecting those terminals 122*a* into the channels 124 may force the terminals 122*a* into closer proximity to the lossy member 174, increasing coupling between the terminals 122*a* and the lossy member 174. In some embodiments, the contact surfaces of the lossy member 174 may be selectively positioned adjacent to the ground terminals 122*a*. Increasing the electrical coupling between the lossy member 174 and the ground terminals 122*a* may increase the effectiveness of the lossy member 174 at improving the performance of the connector 100.

Figure 14:
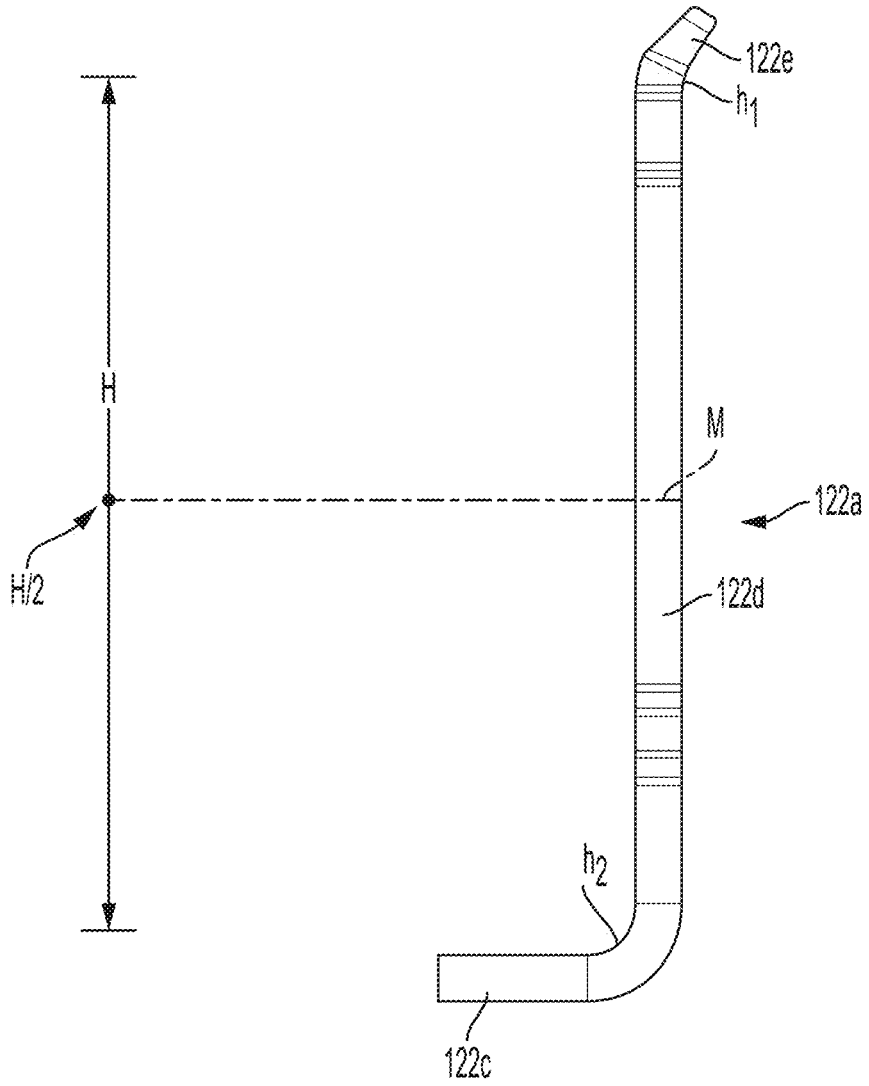
FIG. 14 is a side elevational view of a ground terminal, in accordance with some embodiments of the present technology.

FIG. 14 is a side elevational view of a ground terminal 122*a*. The intermediate portion 122*d* of the ground terminal 122*a* may be substantially straight and may have a longitudinal length H delimited by a first bend $h_1$ adjacent the distal free end 122*e*, and a second bend $h_2$ adjacent the mounting portion 122*c*. A longitudinal midpoint of the ground terminal 122*a* may be defined to be approximately H/2. The longitudinal length H may be used to represent a longitudinal length of the ground terminal 122*a*.

Figure 15A:
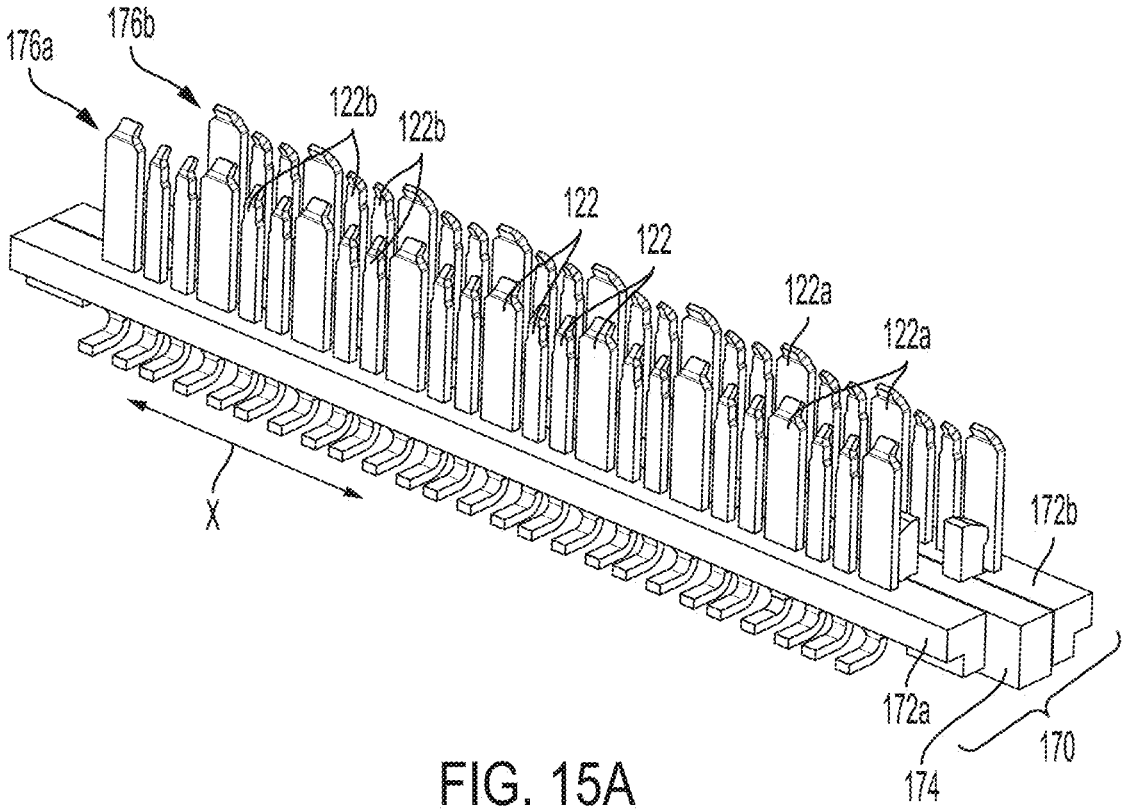
FIGS. 15A and 15B are top perspective views of a terminal assembly of FIG. 12A.
Figure 15B:
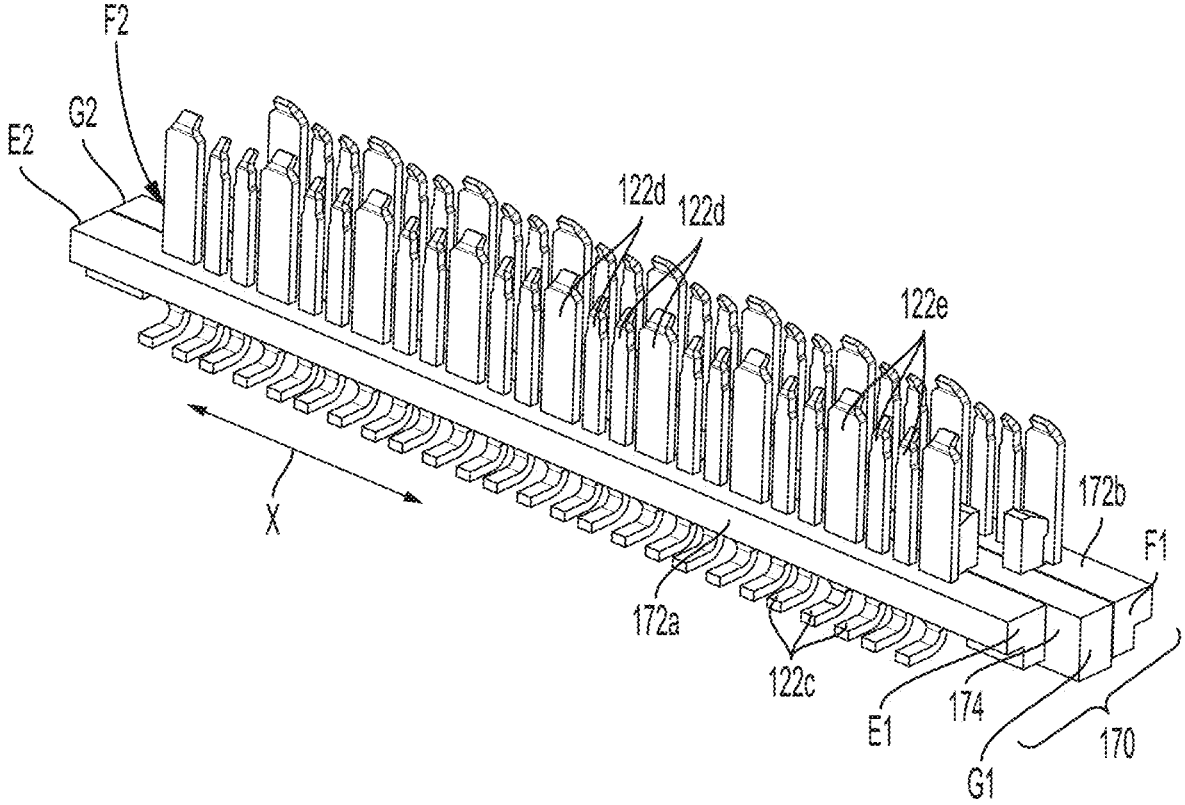
Figure 16:
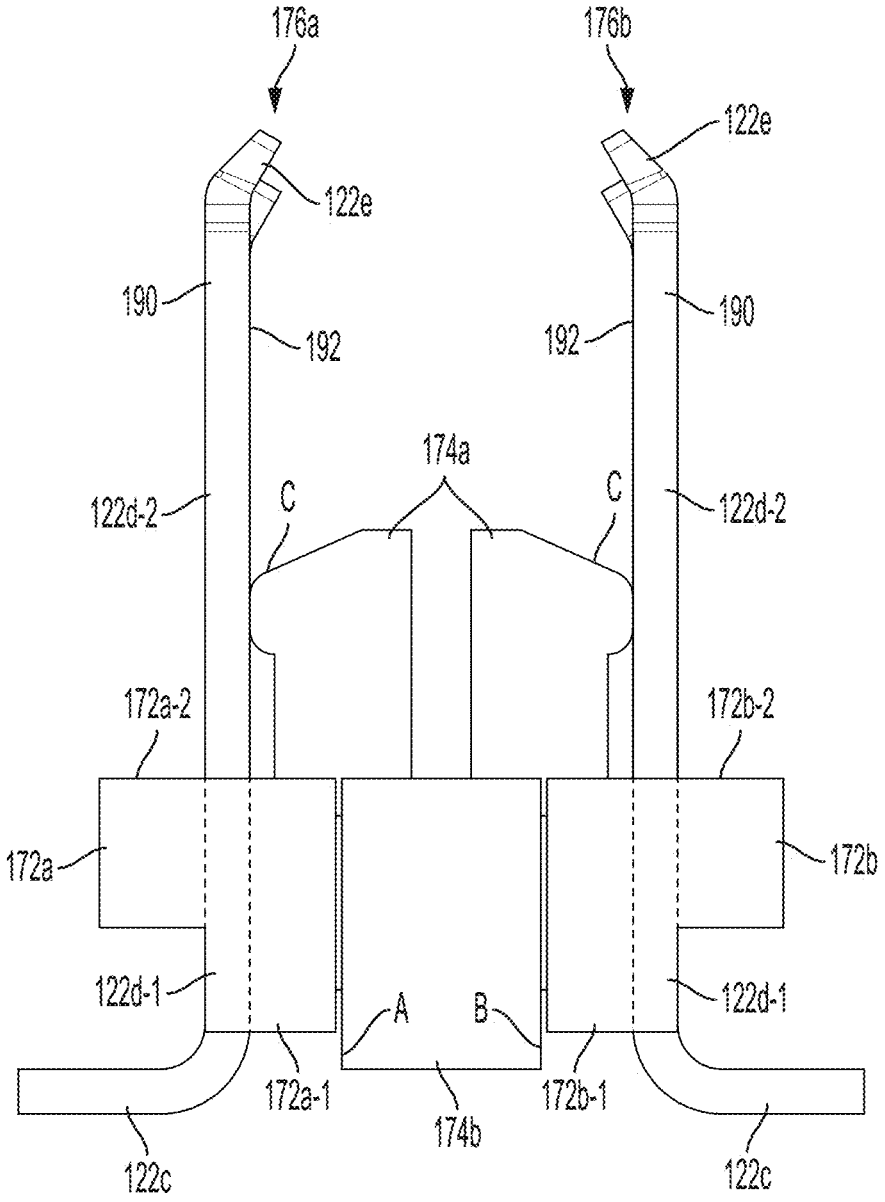
FIG. 16 is a side elevational view of the terminal assembly of FIG. 12A.

The first and second terminal bars 172*a*, 172*b* and the lossy member 174 may extend in directions parallel to the longitudinal direction X of the terminal assembly 170, as shown in FIGS. 15A and 15B. The terminals 122 may be arranged in two parallel rows 176*a*, 176*b* sandwiching the lossy member 174 in between, such that the first and second terminal bars 172*a*, 172*b* are elongated in the row direction X. The mounting portions 122*c* of the terminals 122 may be configured to hook away from the lossy member 174. The first terminal bar 172*a* may be insulative (e.g., formed of plastic) and may be molded around first sections 122*d*-1 of the intermediate portions 122*d* of the first row of terminals 176*a*, such that the mounting portions 122*c* extend from a first side 172*a*-1 of the first terminal bar 172*a*, and such that second sections 122*d*-2 extend from a second side 172*a*-2 of the first terminal bar 172*a* in a direction perpendicular to the row direction X, as depicted in FIG. 16. Similarly, the second terminal bar 172*b* may be insulative and may be molded around first sections 122*d*-1 of the intermediate portions 122*d* of the second row of terminals 176*b*, such that the mounting portions 122*c* extend from a first side 172*b*-1 of the second terminal bar 172*b*, and such that second sections 122*d*-2 extend from a second side 172*b*-2 of the second terminal bar 172*b*.

It should be understood that a lossy member according to the present technology disclosed herein is not limited to the arrangement where the lossy member 174 is positioned between the first and second terminal bars 172*a*, 172*b*. Instead, a lossy member according to the present technology may be positioned differently and structured differently than what is shown, as long as the lossy member performs the functions discussed herein.

Optionally, instead of molding, other means may be used to fix the first and second rows of terminals 176*a*, 176*b* to the first and second terminal bars 172*a*, 172*b*.

Figure 17:
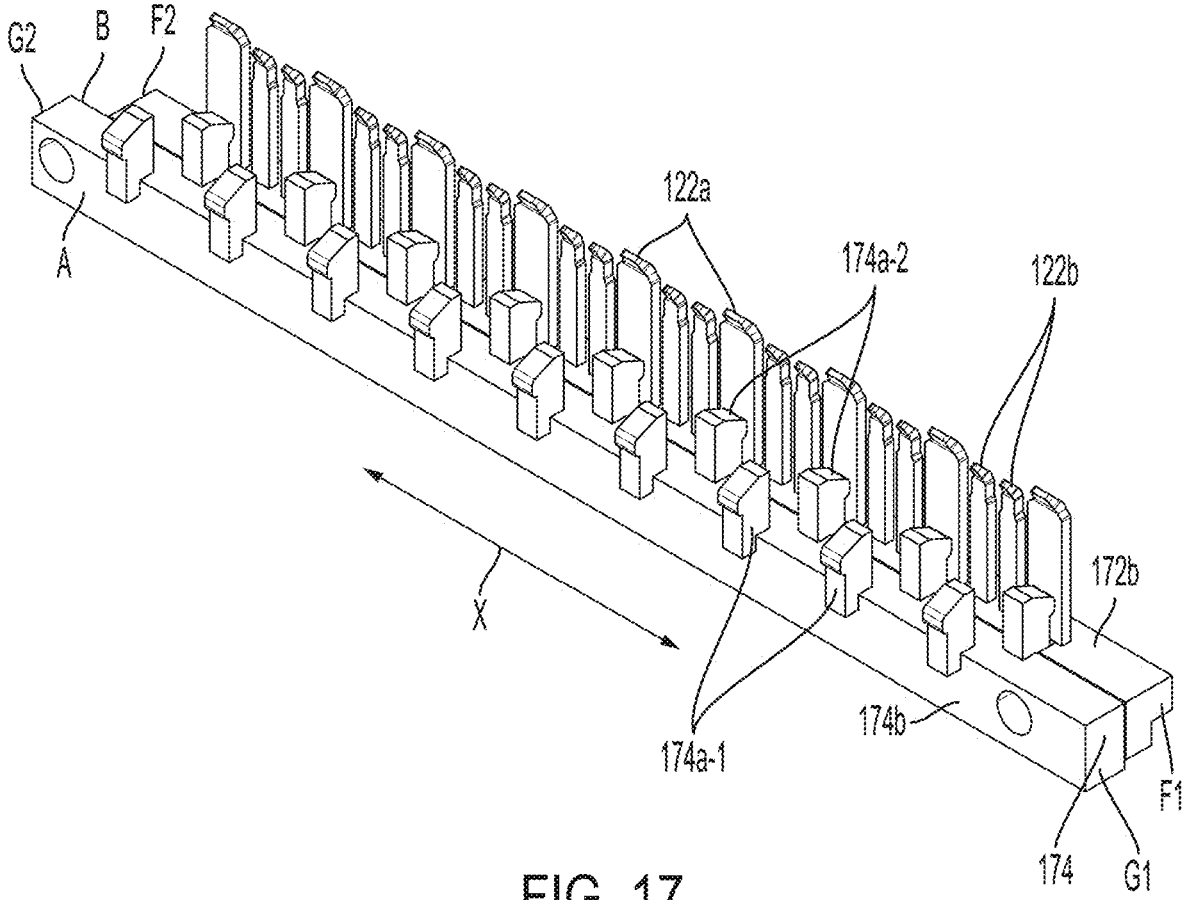
FIG. 17 is a top perspective view of a portion of the terminal assembly of FIG. 12A.

FIG. 17 shows a perspective view of the terminal assembly 170 with the first row of terminals 176*a* removed. The second row of terminals 176*b* includes an alternating arrangement of pairs of signal terminals 122*b* separated by a ground terminal 122*a*. Although not specifically shown, the first row of terminals 176*a* may include a similar alternating arrangement of pairs of signal terminals 122*b* separated by a ground terminal 122*a*.

As shown in FIGS. 16 and 17, the lossy member 174 may include a body 174*b*, here shaped as a bar, and projections 174*a* that extend from the body 174*b* in a direction perpendicular to the longitudinal or row direction X of the terminal assembly 170. Each projection 174*a* may be generally L-shaped and may include a contact region C structured to come into contact with a corresponding one of the ground terminals 122*a* at the second section 122*d*-2 of the intermediate portion 122*d* of the ground terminal 122*a*. Each contact region C of the lossy member 174 may be curved and may extend in a direction perpendicular to the longitudinal or row direction X of the terminal assembly 170 and perpendicular to a longitudinal direction of a corresponding one of the ground terminals 122*a* with which it may make contact.

The terminal subassemblies 170*a*, 170*b* may be designed such that the contact regions C touch the ground terminals 122*a* when the ground terminals 122*a* are deflected, when the receptacle connector 100 mates with a corresponding connector (e.g., the plug connector 200). In some embodiments, the terminal subassemblies 170*a*. 170*b* may be designed such that, even with worst-case manufacturing tolerances that yield a separation between the contact regions C and the ground terminals 122*a* in an un-mated state, in a mated state, those components would touch. In some embodiments, for example, those components may touch with a contact force of at least 5 Newtons, or, in some embodiments, at least 10 Newtons or more.

The body 174*b* of the lossy member 174 may have a first side A on which the first terminal bar 172*a* and the first row of terminals 176*a* are arranged, and a second side B, opposite the first side A, on which the second terminal bar 172*b* and the second row of terminals 176*b* are arranged. The projections 174*a* extending from the lossy member 174 include first projections 174*a*-1 arranged on the first side A of the body 174*b* and second projections 174*a*-2 arranged on the second side B of the body 174*b*. The first projections 174*a*-1 may have a staggered longitudinal arrangement relative to the second projections 174*a*-2 on the body 174*b*, such that no two projections 174*a* on the opposite sides A, B of the body 174*b* share a common longitudinal position along the body 174*b*. Such a configuration, for example, may be used in a connector in which two rows of terminals have the same repeating pattern of signal terminal signal terminal-ground terminal, but the patterns are shifted with respect to each other in the row direction.

Each of the terminals 122 may include a first surface 190 that faces away from the lossy member 174 and a second surface 192 that faces towards the lossy member 174. The contact regions C of the projections 174*a* of the lossy member 174 may extend towards the intermediate portions 122*d* of the ground terminals 122*a*, respectively, and may be positioned adjacent the second surfaces 192 of the ground terminals 122*a*.

As depicted in FIG. 17, the first and second terminal bars 172*a*, 172*b* and the lossy member 174 may be structured such that the first terminal bar 172*a* has a first end E1 and a second end E2, the second terminal bar 172*b* has a first end F1 and a second end F2, and the lossy member 174 has a first end G1 and a second end G2. The lossy member 174 may have a length that is longer than a length of the first terminal bar 172*a* and longer than a length of the second terminal bar 172*b*. The first end G1 of the lossy member 174 is substantially aligned with the first end F1 of the second terminal bar 172*b*, and the second end G2 of the lossy member 174 is substantially aligned with the second end E2 of the first terminal bar 172*b*, such that the second end G2 of the lossy member 174 may extend beyond the second end F2 of the second terminal bar 172*b*, and such that the first end G1 of the lossy member 174 may extend beyond the first end E1 of the first terminal bar 172*a*.

The intermediate portions 122*d* and the contact ends 122*e* of the terminals 122 may extend into an interior cavity of the island 120 such that a portion of each of the terminals 122 may be exposed through the channels or slots 124 in the island 120 and may make contact with corresponding terminals in a plug connector 200.

For example, the opening or interior 118 of the housing 112 may be a plug-receiving opening 118. The two major surfaces 120*a* of the island 120 may be surfaces of island walls 194 and may each face into the opening 118. The channels 124 may include recesses in the island walls 194. The plurality of terminals 122 may be arranged such that exposed parts of the intermediate portions 122*d* and the distal free ends 122*e* extend through the channels 124 in the island walls 194 into the channels 124, such that the first surfaces 190 of the exposed parts face into the opening 118. The channels 124 may be cutouts that extend through a thickness of the island walls 194 and may be structured to accommodate the exposed parts of the plurality of terminals 122, such that a plug connector 200 may make contact with the first surfaces 190 of the exposed parts of the plurality of terminals 122.

Figure 18:
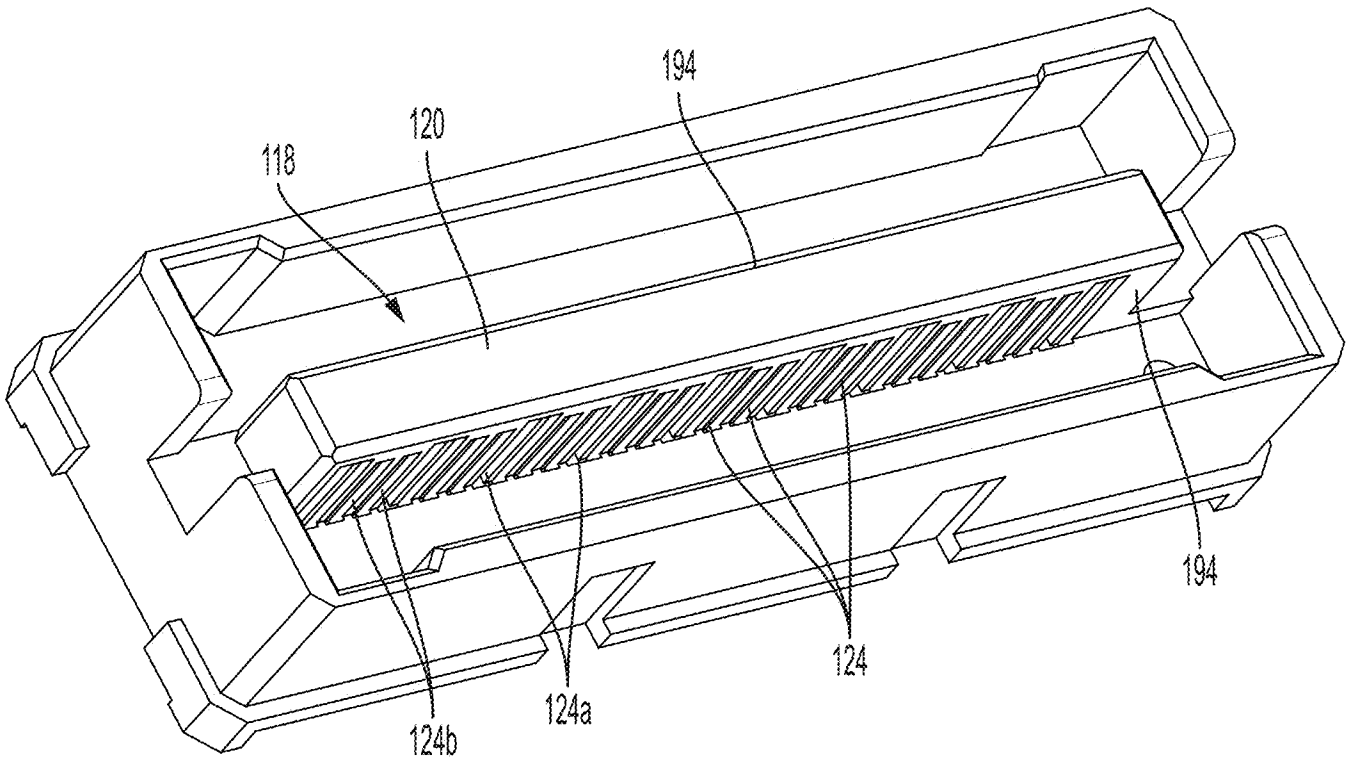
FIG. 18 is a top perspective view of a receptacle housing of the receptacle connector of FIG. 2.

The signal terminals 122*b* may be shaped differently from the ground terminals 122*a*, so the channels 124 may have a first configuration or structure to accommodate the ground terminals 122*a* and a second configuration or structure to accommodate the signal terminals 122*b*, as depicted in FIGS. 3 and 18, which show pairs of narrower channels 124*b* for the pairs of signal terminals 122*b* and wider channels 124*a* for the ground terminals 122*a*, to accommodate the relatively narrower signal terminals 122*b* and the relatively wider ground terminals 122*a*.

Figure 19A:
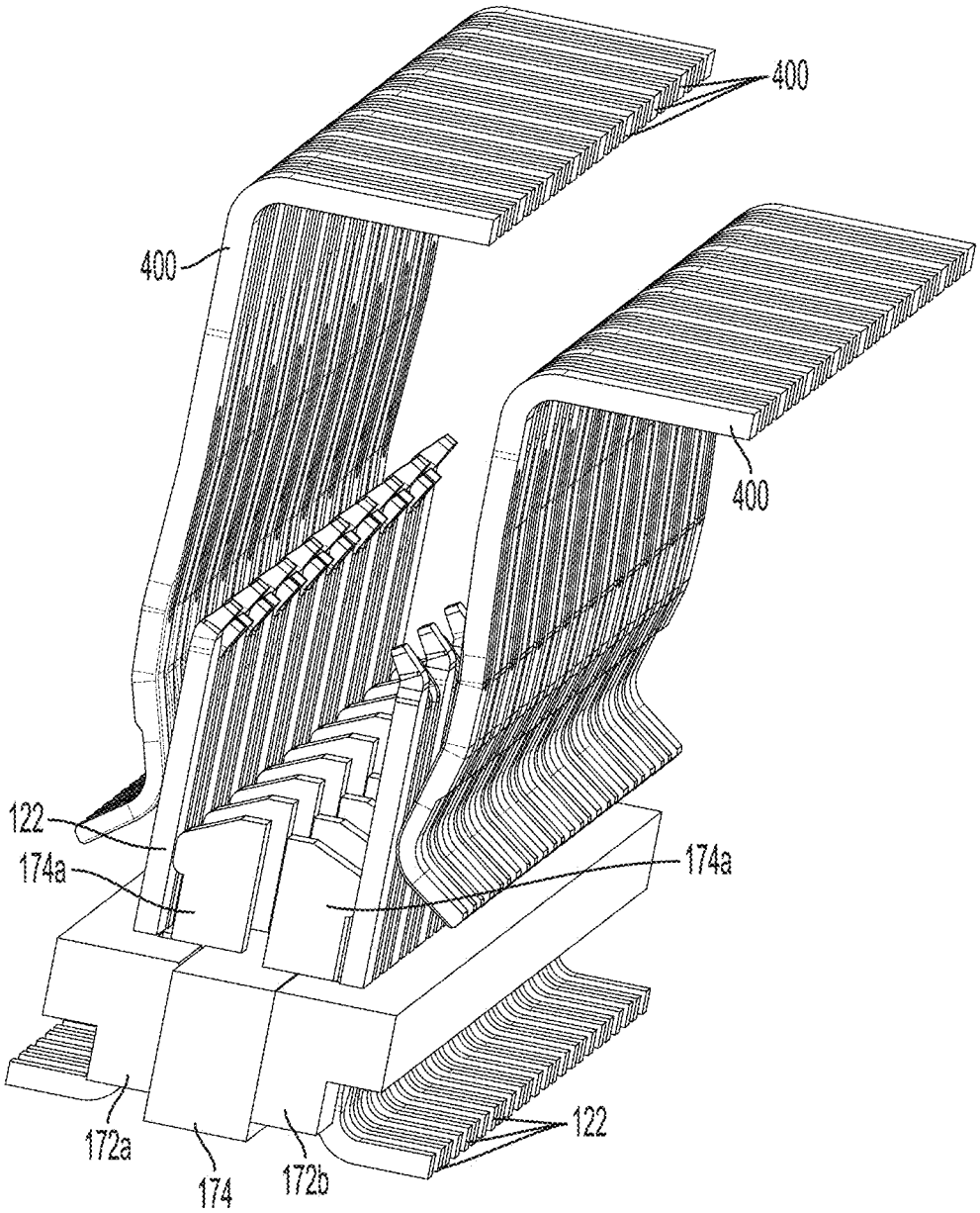
FIG. 19A is a side perspective view of the terminal assembly of FIG. 12A engaged with plug elements of a plug connector, in accordance with some embodiments of the present technology.
Figure 19B:
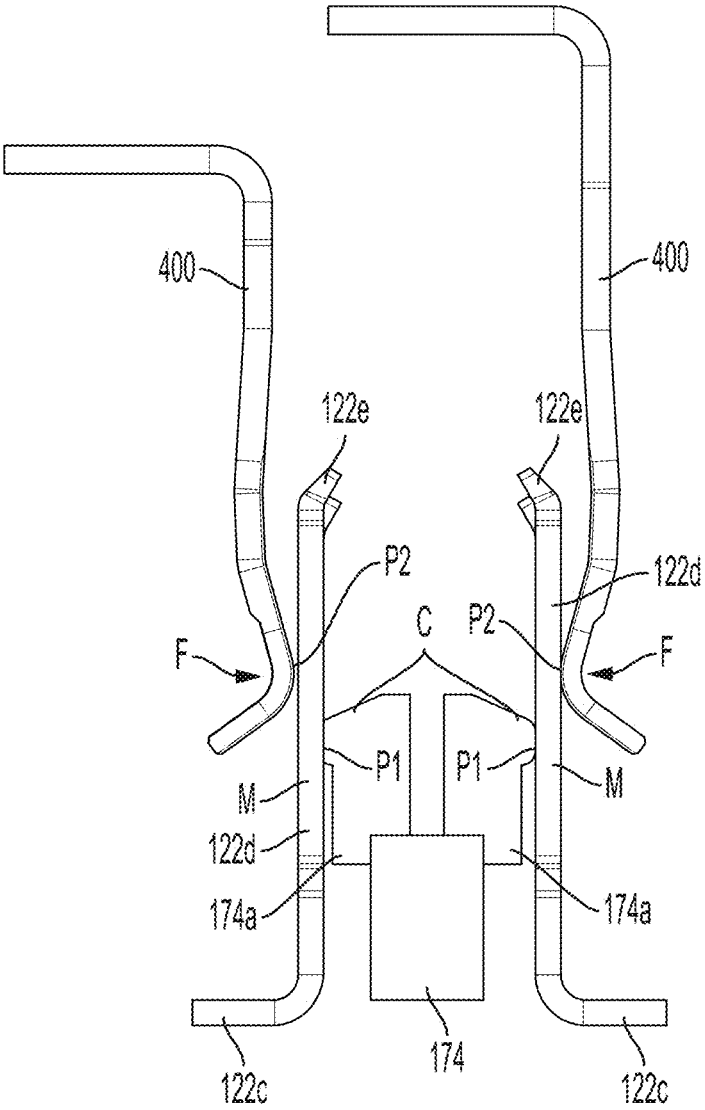
FIG. 19B is a side elevational view showing a relationship between ground elements, plug elements, and a lossy member, in accordance with some embodiments of the present technology.

FIG. 19A is a perspective view of the terminal assembly 170 in a mated state with portions of the plug connector 200. FIG. 19B shows a side elevational view of the relative positions of a ground terminal 122*a* of the receptacle connector 100, a plug terminal 400 of the plug connector 200, and a projection 174*a* of the lossy member 174 of the receptacle connector 100, when the receptacle connector 100 and the plug connector 200 are in the mated state. A contact point P1 between the contact region C of the projection 174*a* of the ground terminal 122*a* may be within a predetermined distance of a longitudinal midpoint of M of the ground terminal 122*a*. A contact point P2 between the plug terminal 400 and the ground terminal 122*a* may be located in a region R of the ground terminal 122*a*. In various embodiments, the region R may be between the midpoint M and the contact end 122*e* of the ground terminal 122*a*. With such a configuration, a force F exerted by the plug terminal 400 when the receptacle connector 100 and the plug connector 200 are in the mated state may urge the ground terminal 122*a* to deflect towards the projection 174*a*, thus enabling or reinforcing a good contact between the lossy member 174 (via the projection 174*a*) and the ground terminal 122*a* and the plug terminal 400.

As discussed above, the longitudinal midpoint of the ground terminal 122*a* may be the longitudinal midpoint H/2 of the intermediate portion 122*c* of the ground terminal 122*a*. In various embodiments, the predetermined distance between the contact point P1 and the midpoint M may be within about 1 mm, or within about 0.8 mm, or within about 0.6 mm, or within about 0.4 mm, or within about 0.2 mm.

In various embodiments, a distance between the contact point P1 and the midpoint M may be within about 1 mm, or within about 0.8 mm, or within about 0.6 mm, or within about 0.4 mm, or within about 0.2 mm, or within about 0.1 mm. In various embodiments, a distance between the contact point P1 and the midpoint M may be within about 40% of the longitudinal length H of the ground terminal 122*a*, or within about 30% of H, or within 20% of H or within 10% of H, or within 5% of H. For example, the distance between the contact point P1 and the midpoint M may be within about 0.2 mm, or within 5% of H.

In various embodiments, a distance between the contact point P2 and the midpoint M may be within about 1 mm, or within about 0.8 mm, or within about 0.6 mm, or within about 0.4 mm, or within about 0.2 mm, or within about 0.1 mm. In various embodiments, a distance between the contact point P2 and the midpoint M may be within about 40% of the longitudinal length H of the ground terminal 122*a*, or within about 30% of H, or within 20% of H or within 10% of H, or within 5% of H. For example, the distance between the contact point P2 and the midpoint M may be within about 0.4 mm, or within 30% of H.

In various embodiments, a distance between the contact point P2 and the contact point P1 may be within about 0.6 mm, or within about 0.4 mm, or within about 0.2 mm, or within about 0.1 mm. In various embodiments, a distance between the contact point P2 and the contact point P1 may be within about 40% of the longitudinal length H of the ground terminal 122*a*, or within about 30% of H, or within 20% of H or within 10% of H, or within 5% of H. For example, the distance between the contact point P2 and the contact point P1 may be within about 0.4 mm., or within 30% of H.

It should be understood that various alterations, modifications, and improvements may be made to the structures, configurations, and methods discussed above, and are intended to be within the spirit and scope of the invention disclosed herein.

For example, a lossy member was used as an example of a shorting member. A shorting member might be made with a combination of lossy material and conductive material. The conductive material, for example, may be partially embedded within the lossy material. In some embodiments, some or all of the projections of the shorting member may be metal.

As another example, a board mounted connector was used as an example of a connector in which techniques for improving signal integrity may be applied. The techniques may be applied in other types of connectors, such as cable connectors. The terminals in such a connector, rather than having contact tails configured as mounting portions for mounting the connector to a printed circuit board, have contact tails of other configurations, such as contact tails configured for termination to a wire of a cable.

Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ± 5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ± 20% of a target value in some embodiments, within ± 10% of a target value in some embodiments, within ± 5% of a target value in some embodiments, and within ± 2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector, comprising:

an insulative portion;

a plurality of terminals supported by the insulative portion and disposed in a row along a row direction, wherein each of the terminals is comprised of a first end, a mounting end, and an intermediate portion joining the first end to the mounting end; and a lossy member comprised of a body portion elongated in the row direction and a plurality of projections extending from the body portion toward the first ends of a plurality of first terminals of the terminals supported by the insulative portion, wherein:

each of the terminals is comprised of a first surface and a second surface opposite the first surface, each of the terminals is comprised of a first contact region on the first surface, and the projections of the lossy member are aligned with the second surfaces of the first terminals.

2. The electrical connector of claim 1, wherein the projections of the lossy member are configured to make contact with the second surfaces of the first terminals.

3. The electrical connector of claim 2, wherein:

the insulative portion is molded around first segments of the intermediate portions of the terminals, second segments of the intermediate portions of the terminals extend from the insulative portion, and the projections of the lossy member are configured to make contact with the second surfaces of the first terminals at locations on the second segments between the insulative portion and the first ends of the first terminals.

4. The electrical connector of claim 3, wherein the mounting ends are comprised of surface-mount contact tails.

5. The electrical connector of claim 1, wherein:

the terminals are comprised of the first terminals and a plurality of second terminals, each of the second terminals has a second width, each of the first terminals has a first width greater than the second width, and the projections of the lossy member are aligned with the second surfaces of the first terminals, and are separated, in the row direction, from the second terminals.

6. The electrical connector of claim 5, wherein:

the second terminals are comprised of pairs of second terminals, and each pair of second terminals is separated from another pair of second terminals by a first terminal.

7. The electrical connector of claim 3, wherein:

the electrical connector is a receptacle connector, the first contact regions are comprised of plug contact regions, and the plug contact regions are configured to make physical contact with corresponding plug terminals when a plug connector is mated with the receptacle connector.

8. The electrical connector of claim 3, further comprising:

an insulative member, wherein:

the insulative member is comprised of a wall, the wall is comprised of a plurality of channels, the first ends and sections of the intermediate portions of the terminals are disposed in the channels such that the first contact regions are exposed, the projections of the lossy member are comprised of second contact regions disposed in first channels of the channels of the wall, the first channels are configured to correspond to the first terminals, and the second contact regions of the projections of the lossy member are disposed in the first channels between the second surfaces of the first terminals and the insulative member.

9. The electrical connector of claim 8, in combination with a plug connector, wherein:

the electrical connector is a receptacle connector, the plug connector is comprised of a plurality of mating terminals contacting the terminals of the receptacle connector at first contact locations in the first contact regions, and the mating terminals apply a force to the first terminals that deflects the first ends of the first terminals, such that the first terminals are urged toward and physically contact the second contact regions of the projections of the lossy member at second contact locations.

10. The electrical connector of claim 9, in combination with the plug connector, wherein, for the first terminals that are in physical contact with the projections of the lossy member at the second contact regions, the first contact locations and the second contact locations are within a predetermined distance from longitudinal midpoints of the first terminals.

11. The electrical connector of claim 10, wherein the predetermined distance is between 0.2 mm and 1 mm.

12. The electrical connector of claim 10, wherein the predetermined distance is less than 0.8 mm.

13. The electrical connector of claim 10, wherein the predetermined distance is less than 0.2 mm.

14. The electrical connector of claim 1, wherein:

the first terminals are ground terminals, for each of the ground terminals, the first end is angled, the mounting end is angled, and the intermediate portion is elongated in a direction perpendicular to the row direction, and a longitudinal midpoint of each of the ground terminals is a longitudinal midpoint of the intermediate portion.

15. The electrical connector of claim 14, wherein, for each of the ground terminals, the intermediate portion is substantially straight.

16. The electrical connector of claim 9, wherein:

the receptacle connector and the plug connector form a pair of connectors of an electronic assembly with a flyover configuration, the receptacle connector is mounted at an interior portion of a printed circuit board of the electronic assembly, the receptacle connector may be mounted next to any one or a combination of:

a processor, a switch, and a high-performance electronic component, and cables extending from the plug connector may be connected to an I/O connector mounted at an edge portion of the printed circuit board.

17. An electrical connector comprising:

an insulative housing;

a plurality of terminals comprised of a plurality of first terminals and a plurality of second terminals;

a first terminal subassembly disposed in the housing, wherein the first terminal subassembly is comprised of a first support bar, and a first portion of the terminals is attached to the first support bar;

a second terminal subassembly disposed in the housing, wherein the second terminal subassembly is comprised of a second support bar, and a second portion of the terminals is attached to the second support bar; and a lossy member disposed in the housing, wherein the lossy member is comprised of a body portion and a plurality of projections extending from the body portion, wherein:

the body portion of the lossy member is disposed between the first support bar and the second support bar, the first and second support bars are elongated in a first direction, each of the terminals is comprised of an intermediate portion extending from the first support bar or the second support bar, each intermediate portion of the terminals is elongated in a second direction perpendicular to the first direction, the projections of the lossy member extend from the body portion in the second direction, and the projections of the lossy member are comprised of a plurality of contact portions that extend towards the intermediate portions of the first terminals, in a direction perpendicular to the first direction and perpendicular to the second direction.

18. The electrical connector of claim 17, wherein each of the projections of the lossy member is L-shaped.

19. The electrical connector of claim 17, wherein:

the first terminals are comprised of ground terminals, the second terminals are comprised of pairs of signal terminals, the pairs of signal terminals and the ground terminals are arranged in an alternating pattern on the first and second support bars, such that no two pairs of the pairs of signal terminals is adjacent each other, and the contact portions of the projections of the lossy member extend towards the intermediate portions of the ground terminals.

20. The electrical connector of claim 17, wherein:

each of the terminals is comprised of a mounting end and a free distal end, the intermediate portions are between the mounting ends and the free distal ends, the mounting ends are configured to be fixedly mounted to a circuit board, and the free distal ends are movable relative to the mounting ends.

21. The electrical connector of claim 20, wherein:

each of the terminals is comprised of a first surface and a second surface, opposite the first surface, the first surface is comprised of a first contact surface, and the contact portions of the projections of the lossy member that extend towards the intermediate portions of the first terminals are positioned adjacent the second surfaces of the first terminals.

22. The electrical connector of claim 21, wherein:

the electrical connector is a receptacle connector, the insulative housing is comprised of a plug-receiving opening and at least one wall with a surface facing into the opening, and the terminals are arranged such that the first surfaces face into the opening and the free distal ends extend into channels in the at least one wall.

23. The electrical connector of claim 22, wherein:

the at least one wall is comprised of first and second walls, the channels are disposed in the first and second walls, the terminals are configured such that the free distal ends are disposed within the channels, and the contact portions of the projections of the lossy member that extend towards the intermediate portions of the first terminals are positioned adjacent the second surfaces of the first terminals and are within corresponding ones of the channels.

24. The electrical connector of claim 17, wherein:

the first support bar of the first terminal subassembly has a first end and a second end, the second support bar of the second terminal subassembly has a first end and a second end, the body portion of the lossy member has a first end and a second end, the body portion of the lossy member is elongated in the first direction and has a length that is longer than a length of the first support bar and longer than a length of the second support bar, and a first end of the body portion of the lossy member is substantially aligned with the first end of the first support bar, and a second end of the body portion of the lossy member is substantially aligned with the second end of the second support bar, such that the first end of the body portion of the lossy member extends beyond the first end of the second support bar, and such that the second end of the body portion of the lossy member extends beyond the second end of the first support bar.

25. The electrical connector of claim 17, wherein:

the body portion of the lossy member is comprised of a first side and a second side, the first terminal subassembly is adjacent the first side, the second terminal subassembly is adjacent the second side, the projections of the lossy member include first projections arranged on the first side of the body portion and second projections arranged on the second side of the body portion, and an arrangement of the first projections on the first side of the body portion relative to an arrangement of the second projections on the second side of the body portion is staggered in the first direction.

26. The electrical connector of claim 25, wherein the arrangement of the first projections and the arrangement of the second projections are such that no two projections of the projections of the lossy member share a common longitudinal position along the body portion of the lossy member.

27. The electrical connector of claim 21, in combination with a plug connector, wherein:

the electrical connector is a receptacle connector, the plug connector is comprised of a plurality of mating terminals contacting the terminals of the receptacle connector at first contact locations in the first contact regions, and the mating terminals apply a force to the terminals of the receptacle connector that deflects the free distal ends of the terminals of the receptacle connector, such that the first terminals of the receptacle connector are urged toward and physically contact the contact portions of the projections of the lossy member at second contact locations on the second surfaces of the first terminals of the receptacle connector.

28. The electrical connector of claim 27, in combination with the plug connector, wherein, for the first terminals of the receptacle connector that are in physical contact with the projections of the lossy member at the second contact locations, the first contact locations and the second contact locations are within a predetermined distance from a longitudinal midpoint of the first terminals.

29. The electrical connector of claim 28, in combination with the plug connector, wherein the predetermined distance is between 0.2 mm and 1 mm.

30. The electrical connector of claim 28, in combination with the plug connector, wherein the predetermined distance is less than 0.8 mm.

31. The electrical connector of claim 28, in combination with the plug connector, wherein the predetermined distance is less than 0.2 mm.

32. The electrical connector of claim 17, wherein:

the first terminals are ground terminals, for each of the ground terminals, an angled first end and an angled second end sandwich the intermediate portion therebetween, and a longitudinal midpoint of each of the ground terminals is a longitudinal midpoint of the intermediate portion.

33. The electrical connector of claim 32, wherein, for each of the ground terminals, the intermediate portion is substantially straight.

34. The electrical connector of claim 27, wherein:

the receptacle connector and the plug connector form a pair of connectors of an electronic assembly with a flyover configuration, the receptacle connector is mounted at an interior portion of a printed circuit board of the electronic assembly, the receptacle connector may be mounted next to any one or a combination of:

a processor, a switch, and a high-performance electronic component, and cables extending from the plug connector may be connected to or near an I/O connector mounted at an edge portion of the printed circuit board.

35. A method of operating an electrical connector, the method comprising:

aligning the electrical connector with a mating electrical connector such that first terminals of the electrical connector align with second terminals of the mating electrical connector; and pressing the electrical connector and the mating electrical connector together such that:

contact points between the first terminals and the second terminals slide in a direction from a first end of the first terminals towards a second end of the first terminals, and the first terminals deflect so as to increase a contact force between the first terminals and electrically interconnected lossy members.

36. The method of claim 35, wherein:

the first terminals are held by an insulative portion of the electrical connector at anchor points that are a first distance from the second end of the first terminals, when the first terminals deflect, the first terminals contact the interconnected lossy members at first contact points that are a second distance from the second end of the first terminals, the second terminals contact the first terminals at second contact points that are a third distance from the second end of the first terminals, the third distance is greater than the second distance, and the second distance is greater than the first distance.

37. The method of claim 35, wherein:

when the first terminals deflect, the contact force between the first terminals and the electrically interconnected lossy members increases from 0 to in excess of 10 Newtons.

38. The electrical connector of claim 1, wherein:

the lossy member is comprised of an electrically lossy material.

* * * * *